US006027866A

United States Patent [19]

Ohzeki

[11] Patent Number: 6,027,866

[45] Date of Patent: Feb. 22, 2000

[54] SILVER HALIDE PHOTOGRAPHIC ELEMENT

[75] Inventor: Tomoyuki Ohzeki, Kanagawa, Japan

[73] Assignee: Fuji Photo Film Co., Ltd., Kanagawa, Japan

[21] Appl. No.: 09/185,618

[22] Filed: Nov. 4, 1998

[30] Foreign Application Priority Data

Nov. 7, 1997 [JP] Japan ..... 9-322355
Dec. 8, 1997 [JP] Japan ..... 9-354105
Dec. 8, 1997 [JP] Japan ..... 9-354106

[51] Int. Cl.[7] ..... G03C 1/35; G03C 1/83

[52] U.S. Cl. ..... 430/521; 430/517; 430/522; 430/965; 430/966

[58] Field of Search ..... 430/517, 521, 430/522, 965, 966

[56] References Cited

U.S. PATENT DOCUMENTS 5,213,951 5/1993 Delfino ..... 430/522
5,468,599 11/1995 Biavasco et al. ..... 430/517

FOREIGN PATENT DOCUMENTS 0 790 526 8/1997 European Pat. Off. .

*Primary Examiner*—Richard L. Schilling
*Attorney, Agent, or Firm*—Sughrue, Mion, Zinn, Macpeak & Seas, PLLC

[57] ABSTRACT

A silver halide photographic element has a silver halide emulsion layer primarily containing tabular silver halide grains and a hydrophilic colloid layer, either of which contains a pigment with a maximum absorption wavelength of 570–650 nm dispersed in lipophilic droplets of a high-boiling organic solvent. The photographic element has a high sensitivity and high silver covering power, and is improved in the transmission and reflection blackness of image silver and staining of fluorescent intensifying screens.

10 Claims, No Drawings

SILVER HALIDE PHOTOGRAPHIC ELEMENT

This invention relates to a silver halide photographic element having a satisfactory image tone and minimized staining to fluorescent intensifying screens.

BACKGROUND OF THE INVENTION

Emulsion manufacturers are deeply interested in the covering power of silver halide emulsions because the use of an emulsion having a higher covering power leads to a saving of the amount of silver necessary to maintain a certain optical density.

U.S. Pat. Nos. 4,411,986, 4,434,226, 4,413,053, 4,414,304, 4,414,306, and 4,435,501 disclose that the covering power of developed silver is considerably increased by using tabular grains having a high aspect ratio and a reduced thickness.

Extremely thin tabular grains having a thickness of less than 0.07 μm are disclosed in JP-A 99751/1987, 115435/1987, 43605/1994, and 43606/1994.

EP 0699944A, 0699946A, 0699947A, JP-A 101476/1997, 101475/1997, 101473/1997, 101472/1997, 69069/1997, and U.S. Pat. No. 5,494,789 disclose techniques relating to high aspect ratio tabular grains having epitaxial sites.

However, the tone of developed silver resulting from emulsion grains providing a high covering power, which depends on the size and thickness of grains, is almost always yellowish and gives an unpleasant impression to the image viewer. The tone becomes yellowish because as the size and thickness of grains decrease, the developed silver is also decreased in size and thickness so that the scattering of blue light components increases to produce more yellowish light. This phenomenon becomes a problem particularly when fine grain emulsions (e.g., mean particle size less than 0.4 μm) or tabular grains having a reduced thickness (e.g., particle thickness less than 0.4 μm) are used as the silver halide emulsion. In general, compounds known as toners are often used for adjusting the tone of developed silver. For example, certain mercapto compounds are used as the toner. However, even when such conventional well-known toners are applied to emulsions containing high sensitivity silver halide grains, they incur substantial desensitization and are thus impractical.

Then, as described in JP-A 154251/1985, 276539/1987, 285445/1986, and 204085/1993, it is widely practiced to control the tone by containing substantially water-insoluble dyestuffs in photosensitive elements so that the tone of developed silver may become neutral black. Also, JP-A 234035/1992, 199394/1995 and EP 655645A1 disclose that pigments are contained in photosensitive elements for adjusting the tone of developed silver and improving the residual color of a spectral sensitizing dye after processing. In this case, however, not only the transmission tone of developed silver becomes yellowish, but the reflection tone of developed silver also becomes reddish brown, giving a disgustful impression.

In general, where external light is present on observation of transmitted light, a certain proportion of reflected light is often contained therein. Thus it is desired that the reflection tone of developed silver be black. In this regard, the above-discussed prior art techniques are not satisfactory.

Moreover, these techniques have the problem that if a cleaner is left on a fluorescent intensifying screen used on radiographic photographing, the screen can be colored or stained with the dyestuff or pigment contained in the photosensitive element. Another problem is that if pressure or friction is applied to the photosensitive element during handling thereof, the dyestuff or pigment contained in the photosensitive element causes staining of the photosensitive element itself or the rubbing object.

SUMMARY OF THE INVENTION

An object of the present invention is to provide a silver halide photographic element having improved transmission and reflection blackness of image silver, high sensitivity, a high silver covering power, and minimized residual color.

Another object of the present invention is to provide such a silver halide photographic element further having minimized staining to fluorescent intensifying screens.

An object of the present invention is to provide such a silver halide photographic element having improved image recognition after development.

According to the invention, there is provided a silver halide photographic element comprising at least one silver halide emulsion layer on a support. The silver halide emulsion layer contains silver halide grains, and tabular grains having an aspect ratio of at least 5 account for at least 50% of the total projected area of the silver halide grains. The silver halide emulsion layer and/or a hydrophilic colloid layer disposed above the silver halide emulsion layer contains a pigment having a maximum absorption wavelength between 570 nm and 650 nm. The pigment is dispersed in lipophilic droplets formed of a water-immiscible high-boiling organic solvent having a boiling point of at least 140° C.

Preferably, the pigment is contained in the hydrophilic colloid layer disposed above the silver halide emulsion layer; or a surface protective layer; or the hydrophilic colloid layer disposed above the silver halide emulsion layer and below a surface protective layer. Preferably, the element has a white light transmission density of unexposed areas after development of 0.15 to 0.35, and the pigment is contained in such an amount that the pigment may contribute to at least 50%, more preferably at least 80% of the white light transmission density of unexposed areas after development. The pigment is typically (1) an anthraquinone pigment or (2) a metal phthalocyanine pigment and a dioxazine pigment.

Also preferably, the tabular grains have been chemically sensitized with a selenium compound, tellurium compound or a mixture thereof.

Preferably, the support has not been dyed. If a subbing layer is present on the support, the subbing layer has not been dyed.

DETAILED DESCRIPTION OF THE INVENTION

In the silver halide photographic element of the invention, tabular grains having an aspect ratio of at least 5 account for at least 50% of the total projected area of silver halide grains in a silver halide emulsion layer, and a specific pigment is contained in the silver halide emulsion layer or a hydrophilic colloid layer disposed thereabove. The pigment is contained as an oil dispersion by dispersing it in lipophilic droplets formed of a water-immiscible high-boiling organic solvent having a boiling point of at least 140° C. The term "pigment" designates those of dyes which are insoluble or difficultly soluble in water and organic solvents.

Use of silver halide grains having a high tabularity provides a high sensitivity and a high covering power. The containment of the pigment in the selected hydrophilic colloid layer as an oil dispersion improves the blackness of image silver and minimizes staining of fluorescent intensifying screens or the like. In contrast, if the pigment is not contained in the selected hydrophilic colloid layer, the silver tone is exacerbated. Also, if the pigment is contained as a water dispersion, the improvement in staining of fluorescent intensifying screens becomes insufficient, allowing staining to occur upon application of pressure or friction. If a dyestuff is used as an emulsion, the staining of fluorescent intensifying screens becomes outstanding.

It is noted that the staining of fluorescent intensifying screens, especially upon application of pressure or friction becomes a problem when pigments or dyestuffs are contained in a surface protective layer. The problem is overcome by containing a pigment or dyestuff as an oil dispersion. Therefore, the embodiment wherein a pigment is contained as an oil dispersion is effective particularly when applied to the surface protective layer.

From the standpoint of improvement in silver tone, the pigment is preferably contained in such an amount that the pigment may contribute to at least 50% of the white light transmission density of unexposed areas after development.

Now the invention is described in more detail.

The silver halide photographic element has at least one silver halide emulsion layer on a support. There may be included only one silver halide emulsion layer or a plurality of silver halide emulsion layers, preferably not more than 4 layers.

In the silver halide emulsion layer and/or a hydrophilic colloid layer disposed above the silver halide emulsion layer, a pigment having a maximum absorption wavelength between 570 nm and 650 nm, preferably between 580 nm and 640 nm, is contained. The pigment may be used alone or in combination. In either case, the maximum absorption wavelength should fall in the range of 570 nm to 650 nm, preferably 580 nm to 640 nm.

The pigments which can be used herein include commercially available ones and well-known ones described in the following literature. Included are Colour Index, edited by The Society of Dyers and Colourists; "New Edition Pigment Handbook," edited by the Japanese Pigment Technology Society, 1989; "Advanced Pigment Application Technology," CMC Publishing K.K., 1986, "Printing Ink Technology," CMC Publishing K.K., 1984, and W. Herbst & K. Hunger, "Industrial Organic Pigments," VCH Verlagsgesellshaft, 1993. More illustratively, organic pigments which can be used herein include azo pigments (e.g., azo lake pigments, insoluble azo pigments, condensed azo pigments, and chelate azo pigments), polycyclic pigments (e.g., phthalocyanine pigments, anthraquinone pigments, perylene and perinone pigments, indigo pigments, quinacridone pigments, dioxazine pigments, isoindolinone pigments, quinophthalone pigments, and diketopyrrolopyrrole pigments), dyeing lake pigments (e.g., lake pigments of acidic or basic dyes), and azine pigments. Inorganic pigments are also useful. Inter alia, phthalocyanine pigments, anthraquinone family indanthrone pigments, triarylcarbonium pigments belonging to the dyeing lake pigments, indigo pigments as well as inorganic pigments such as ultramarine and cobalt blue are preferable for obtaining favorable blue tone. In combination with the above blue pigments, red or purple pigments such as dioxazine pigments, quinacridone pigments, and diketopyrrolopyrrole pigments may be used for adjusting the tone. Anthraquinone pigments and combinations of metal phthalocyanine pigments with dioxazine pigments are preferable.

Illustrative preferred examples of the pigment are given below. Examples of the blue pigment include phthalocyanine C.I. Pigment Blue 15, 15:1, 15:2, 15:3, 15:4, 15:6 (copper phthalocyanine), monochloro or low chlorinated copper phthalocyanine, C.I. Pigment Blue 16 (metal-free phthalocyanine), phthalocyanine having Zn, Al or Ti as the center metal, indanthrone family C.I. Pigment Blue 60, also known as vat dye, and halogen-substituted ones thereof, for example, C.I. Pigment Blue 64, 21, azo family C.I. Pigment Blue 25, indigo family C.I. Pigment Blue 66, C.I. Pigment Blue 63 belonging to lake pigments, C.I. Pigment Blue 1, 2, 3, 9, 10, 14, 18, 19, 24:1, 24:x, 56, 61 and 62 belonging to lake pigments of triarylcarbonium type acidic dyes or basic dyes. The red or purple pigments include dioxazine family C.I. Pigment Violet 23 and 37, azo family C.I. Pigment Violet 13, 25, 32, 44 and 50, C.I. Pigment Red 23, 52:1, 57:1, 63:2, 146, 150, 151, 175, 176, 185, 187 and 245, quinacridone family C.I. Pigment Violet 19 and 42, C.I. Pigment Red 122, 192, 202, 207, and 209, C.I. Pigment Violet 1, 2, 3, 27 and 39 belonging to triarylcarbonium type lake pigments, C.I. Pigment Red 81:1, perylene family C.I. Pigment Violet 29, anthraquinone family C.I. Pigment Violet 5:1, 31 and 33, thioindigo family C.I. Pigment Red 38 and 88.

Illustrative preferred examples of the pigment used herein are C.I. Pigment Blue 60 (designated Compound (1)) and copper phthalocyanine (designated Compound (2)) such as C.I. Pigment Blue 15, optionally in combination with C.I. Pigment Violet 23 (designated Compound (3)) or C.I. Pigment Violet 37 (designated Compound (4)). When copper phthalocyanine is used in combination with C.I. Pigment Violet 23 or C.I. Pigment Violet 37, their weight ratio is preferably from 50:1 to 1:1, more preferably from 40:1 to 3:1.

Compound (1)

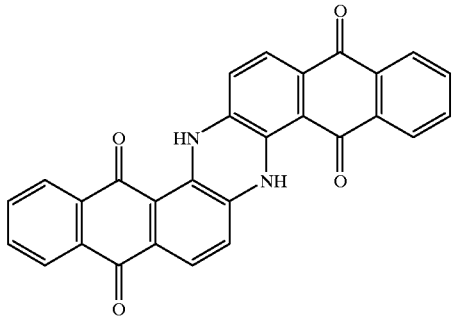

-continued

Compound (2)

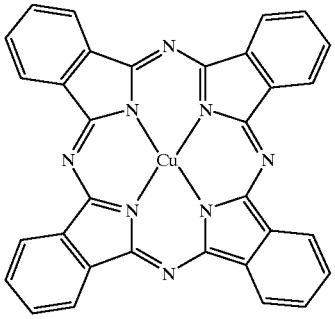

Compound (3)

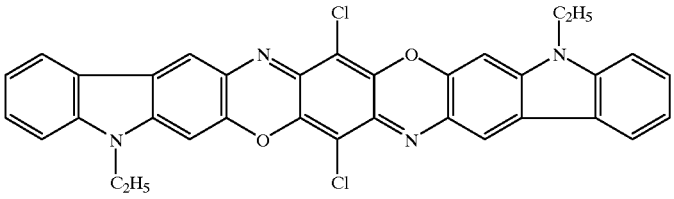

Compound (4)

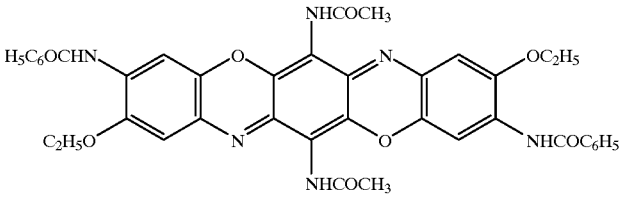

The pigments which can be used herein may be either bare pigments as described above or surface-treated pigments. The methods of surface treatment include surface coating of resins or wax, application of surfactants, and binding of reactive substances (e.g., silane coupling agent, epoxy compounds, and polyisocyanates) to the pigment surface. These methods are described in "Properties and Application of Metal Soaps," Yuki Shobo K.K., "Printing Ink Technology," CMC Publishing K.K., 1984, and "Advanced Pigment Application Technology," CMC Publishing K.K., 1986.

In the practice of the invention, the pigment is used as a dispersion in a binder. A dispersant is selected in accordance with a particular binder and pigment, for example, from surfactant type low molecular weight dispersants and high molecular weight dispersants. Exemplary dispersants are described, for example, in JP-A 69949/1991 and EP 549, 486.

According to the invention, the pigment is dispersed in lipophilic droplets formed of a water-immiscible high-boiling organic solvent having a boiling point of at least 140° C. In this sense, the pigment which has been surface treated so that it may be readily dispersed in the organic solvent is preferred.

The high-boiling organic solvents used herein are water-immiscible compounds having a boiling point of at least 140° C. Preferably the high-boiling organic solvents have a melting point of up to 80° C. The lower limit of the melting point is not critical although it is usually about −100° C. The boiling point of the high-boiling organic solvent is preferably at least 160° C., more preferably at least 170° C. The upper limit of the boiling point is not critical although it is usually about 400° C. If the boiling point of a solvent is below 140° C., it will readily evaporate when the photographic emulsion is coated and dried, so that the solvent might not be co-present with the pigment as oil droplets in the photosensitive element. If the solvent is miscible with water, the surface of a coating can be exacerbated when the emulsion is coated or when the photosensitive element after coating and drying is developed. The high-boiling organic solvent has a solubility in water of up to 2% by weight at 25° C.

The amount of the high-boiling organic solvent used varies over a wide range depending on the type and amount of the pigment. Preferably the weight ratio of high-boiling organic solvent to pigment is from 0.05 to 20, more preferably from 0.1 to 10.

The high-boiling organic solvents may be used alone or in admixture of two or more. Preferred examples of the high-boiling organic solvent used herein are compounds of the following formulas (I) to (VI).

Formula (I)

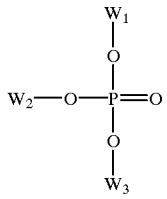

Formula (II)

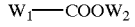

-continued

Formula (III)

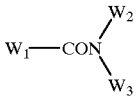

Formula (IV)

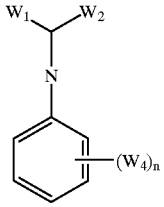

Formula (V)

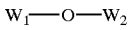

Formula (VI)

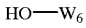

In the formulas, $W_1$, $W_2$ and $W_3$ each are substituted or unsubstituted alkyl, cycloalkyl, alkenyl, aryl or heterocyclic groups, $W_4$ represents $W_1$, O—$W_1$ or S—$W_1$, letter n is an integer of 1 to 5. When n is 2 or more, the $W_4$ groups may be the same or different. In formula (V), $W_1$ and $W_2$ may bond together to form a fused ring. $W_6$ is a substituted or unsubstituted alkyl or aryl group, with the number of carbon atoms in $W_6$ being at least 12. The upper limit of the number of carbon atoms in $W_6$ is not critical though it is about 50.

Of the compounds of formulas (I) to (VI), the compounds of formula (I) are especially preferred.

Illustrative, non-limiting examples of the high-boiling organic solvent used herein are given below.

(S-1)

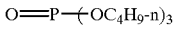

(S-2)

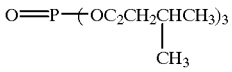

(S-3)

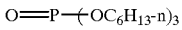

(S-4)

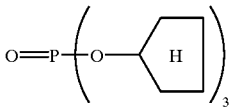

(S-5)

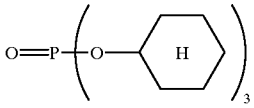

(S-6)

(S-7)

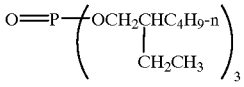

-continued (S-8)

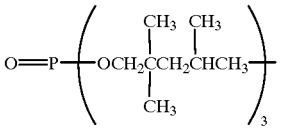

(S-9)

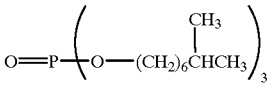

(S-10)

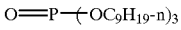

(S-11)

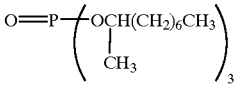

(S-12)

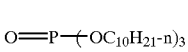

(S-13)

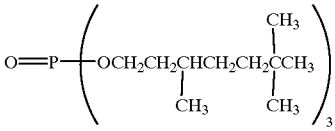

(S-14)

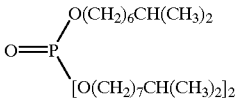

(S-15)

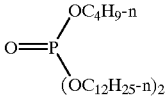

(S-16)

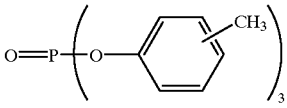

(S-17)

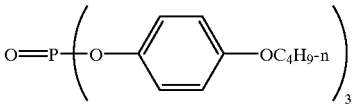

(S-18)

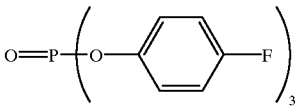

(S-19)

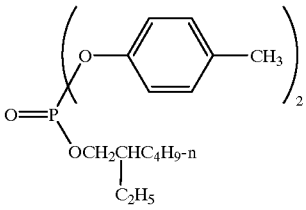

(S-20)

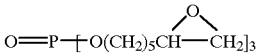

-continued
(S-21)
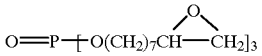
(S-22)
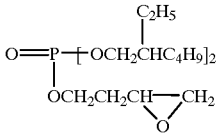
(S-23)
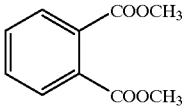
(S-24)
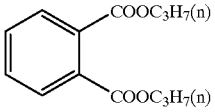
(S-25)
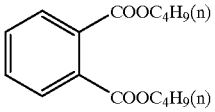
(S-26)
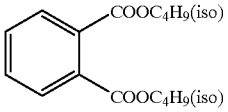
(S-27)
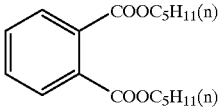
(S-28)
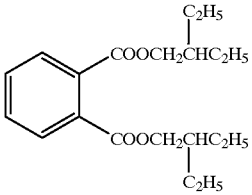
(S-29)
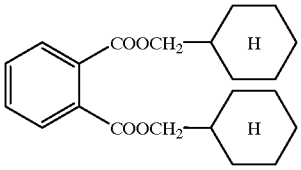
(S-30)
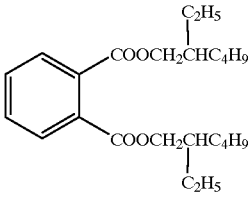
-continued
(S-31)
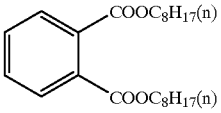
(S-32)
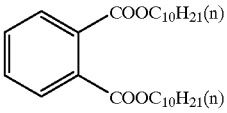
(S-33)
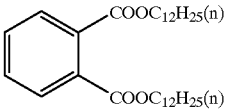
(S-34)
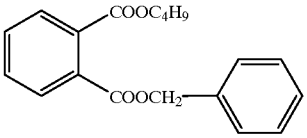
(S-35)
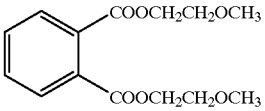
(S-36)
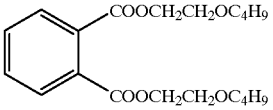
(S-37)
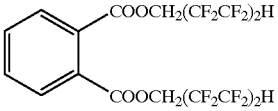
(S-38)
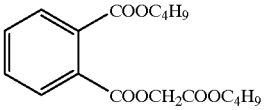
(S-39)
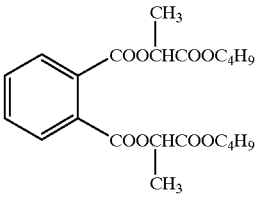
(S-40)
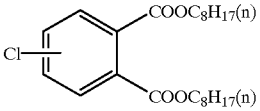
(S-41)
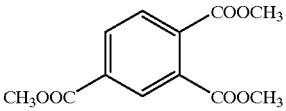

-continued
(S-42)
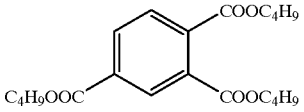
(S-43)
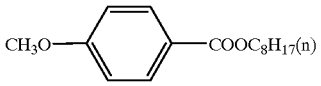
(S-44)
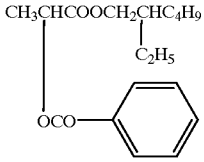
(S-45)
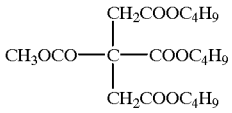
(S-46)
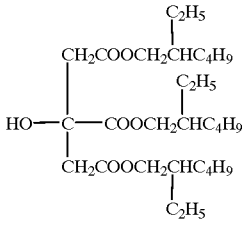
(S-47)
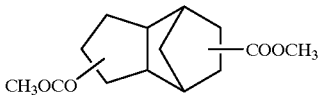
(S-48)
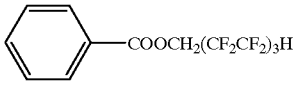
(S-49)
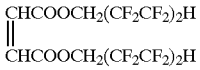
(S-50)
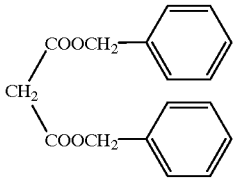
(S-51)
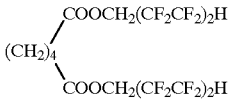
(S-52)
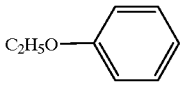
-continued
(S-53)
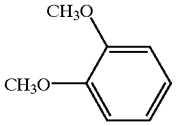
(S-54)
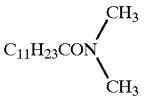
(S-55)
$C_{12}H_{25}OH$
(S-56)
$C_{16}H_{33}OH$
(S-57)
$C_{18}H_{37}OH$
(S-58)
$C_{10}H_{21}O(CH_2)_5O(CH_2)_2OH$
(S-59)
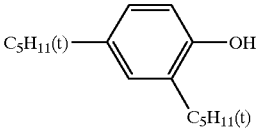
(S-60)
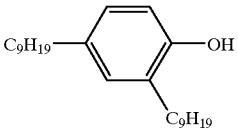
(S-61)
$CH_3(CH_2)_{17}Cl$
(S-62)
$CH_3(CH_2)_{15}Br$
(S-63)
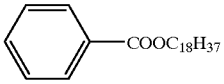
(S-64)
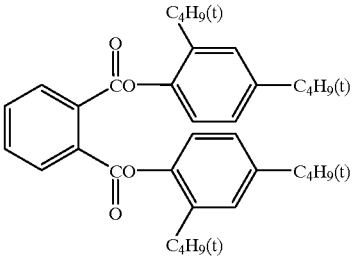
(S-65)
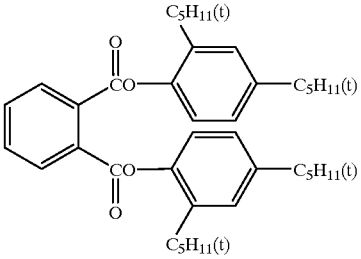

-continued (S-66)

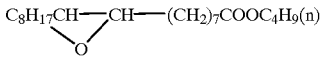

(S-67)

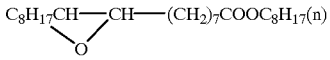

(S-68)

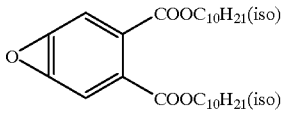

(S-69)

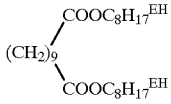

(S-70)

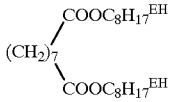

EH = ethylhexyl

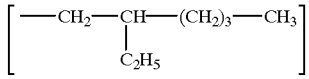

The dispersion of lipophilic droplets containing the pigment and the high-boiling organic solvent according to the invention is prepared as follows. The surface treated pigment is completely dispersed in an auxiliary organic solvent by application of ultrasonic waves or the like, the high-boiling organic solvent is dissolved therein, and the liquid is dispersed as microparticulates in water, preferably in a hydrophilic colloid aqueous solution, more preferably with the aid of a dispersant, by means of a ultrasonic mixer, colloid mill or homogenizer. Alternatively, water or a hydrophilic colloid aqueous solution such as an aqueous gelatin solution is added to an auxiliary organic solvent containing a dispersant such as a surfactant, the inventive pigment, and the high-boiling organic solvent, obtaining an oil-in-water dispersion accompanied by phase transfer. And, the auxiliary organic solvent is preferably removed from the dispersion by a suitable technique such as distillation, noodle water washing or ultrafiltration.

The auxiliary organic solvent is an organic solvent which is effective during dispersion and is to be eventually removed from the photosensitive element in the drying step after coating or by the above technique. Included are low-boiling organic solvents or solvents having some solubility in water and removable by water washing.

Examples of the auxiliary organic solvent include acetates of lower alcohols such as ethyl acetate and butyl acetate, ethyl propionate, sec-butyl alcohol, methyl ethyl ketone, methyl isobutyl ketone, β-ethoxyethyl acetate, methyl cellosolve acetate, methyl carbitol acetate, methyl carbitol propionate, and cyclohexanone.

If desired, an organic solvent completely miscible with water, for example, methyl alcohol, ethyl alcohol, acetone or tetrahydrofuran may be partially used in combination. A mixture of such organic solvents is also useful.

In the lipophilic droplets, various photographic hydrophobic substances may be contained. Exemplary photographic hydrophobic substances include colored couplers, non-dye-forming couplers, developing agents, developing agent precursors, development inhibitor precursors, UV absorbers, development promoters, gradation adjusting agents such as hydroquinone, dye-releasing agents, antioxidants, fluorescent brighteners, and anti-fading agents. These hydrophobic substances may be used in admixture.

According to the invention, the lipophilic droplets desirably have a size of 0.4 to 0.1 μm. A size of more than 0.4 μm would increase scattering of visible light, causing haze. A size of less than 0.1 μm would lower the age stability of an emulsion. A size of 0.15 to 0.35 μm is more preferable.

The pigment used herein preferably has a mean particle size of 0.01 to 10 μm, more preferably 0.05 to 1 μm, after dispersion.

In dispersing the pigment in the binder, well-known dispersing techniques used in the manufacture of ink and toner may be used. Useful dispersing machines include sand mills, attritors, pearl mills, super mills, ball mills, impellers, dispersers, KD mills, colloid mills, dynatrons, three-roll mills, and pressure kneaders. The detail is described in "Advanced Pigment Application Technology," CMC Publishing K.K., 1986.

In the practice of the invention, the pigment is contained in the silver halide emulsion layer and/or a hydrophilic colloid layer disposed above the silver halide emulsion layer, preferably in such an amount that the pigment may contribute to at least 50%, more preferably at least 80%, of the white light transmission density of unexposed areas after development. A contribution of at least 80% improves the recognition of an image after development.

The contribution to the density is evaluated by subjecting an unexposed sample to only fixation and water washing or if a dye which will decolorize in the developing step is contained, by further subjecting the sample to development, fixation and water washing. In either case, the sample is thoroughly washed with water in order to remove the residual color of the spectral sensitizing dye, and dried. The difference between the white light transmission density of this sample and the white light transmission density of the support used therein is the density of the pigment. The proportion of the pigment's density in the white light transmission density of unexposed areas after development is the contribution to density of the pigment. The white light transmission density is not particularly specified as long as it is measured using a luminosity compensation filter. It is preferred to use, for example, Corning filter 4-76 or the visual filter of a Macbeth densitometer.

The amount of the pigment added is preferably 1 to 100 $mg/m^2$, more preferably 20 to 70 $mg/m^2$ per one side of the photosensitive element. The site of addition is preferably the silver halide emulsion layer and/or a hydrophilic colloid layer disposed above the silver halide emulsion layer. One of the objects of the invention is to absorb undesirable reflected light components of developed silver at a position above the developed silver. Accordingly, merely adding the inventive pigment to the silver halide emulsion layer is sometimes insufficient, and in such cases, it is preferred to add the inventive pigment to a hydrophilic colloid layer that is disposed remote from the support with respect to the silver halide emulsion layer. The hydrophilic colloid layer to which the inventive pigment is added may be a protective layer disposed as the uppermost layer or an intermediate layer disposed between the protective layer and the emulsion layer.

If the pigment is loosely secured within the silver halide photosensitive element, a fluorescent intensifying screen or an automatic processor can be stained. In this case, the addition of the inventive pigment to the intermediate layer is preferred. The invention is characterized in that even when the pigment is added to the surface protective layer, such staining is avoided on account of the oil dispersion of the pigment.

The supports used herein include films of semi-synthetic or synthetic polymers such as cellulose nitrate, cellulose acetate, cellulose acetate butyrate, polystyrene, polyvinyl chloride, polyethylene terephthalate, and polycarbonate, and sheets of paper coated or laminated with baryta layers or alpha-olefin polymers (e.g., polyethylene, polypropylene, and ethylene/butene copolymers).

The support used herein may be colored or dyed with dyestuffs or pigments while a subbing layer for improving adhesion to a photographic emulsion layer may also be colored with dyestuffs or pigments. Since the silver halide emulsion layer and/or the overlying hydrophilic colloid layer is colored with the pigment according to the invention, the support is preferably colored to such a degree that the density of unexposed areas may not be too high. Of the white light transmission density of unexposed areas after development, the contribution by coloring of the support (inclusive of the contribution of the subbing layer if any) should preferably be less than 50%, more preferably up to 48%, further preferably less than 20%, still further preferably up to 18%, most preferably less than 10%, and especially up to 8%. It is most preferred that the support (inclusive of the subbing layer if any) is not colored at all. Then, the photosensitive element of the invention has a white light transmission density of unexposed areas after development of from 0.15 to 0.35, preferably from 0.15 to 0.25. The term "development" is used as indicating a series of steps including development, fixation, water washing and so on.

Silver Halide Emulsion

Now the tabular silver halide emulsion used herein is described. The silver halide emulsion used in the silver halide photographic element according to the invention may have any silver halide composition including silver chloride, silver chlorobromide, silver chloroiodide, silver chloroiodobromide, silver bromide, and silver iodobromide. Silver iodobromide is preferred for high sensitivity while silver chloride and silver chlorobromide are preferred for effective fixation. In either case, the silver halide should have a silver iodide content of up to 1 mol %, preferably 0 to 0.45 mol %.

For the silver halide emulsion used herein, an average diameter of an equivalent circle to the projected area of silver halide grains is calculated as an average value of all silver halide grains. The average equivalent circle diameter is preferably 0.1 to 2.0 $\mu$m, more preferably 0.1 to 1.8 $\mu$m, most preferably 0.3 to 1.8 $\mu$m.

Silver halide grains in the silver halide emulsion may be isotropically grown grains such as cubic, octahedral and tetradecahedral shape, optionally in admixture with multiplanar crystals such as spherical shape. Tabular grains having parallel twin crystal faces and {111} major faces and tabular grains having {100} major faces are also useful.

Tabular silver halide grains preferably have a thickness of 0.05 to 0.25 $\mu$m, more preferably 0.05 to 0.2 $\mu$m.

The aspect ratio of tabular silver halide grains is defined as a diameter of an equivalent circle to the projected area of a grain divided by a thickness of that grain. According to the invention, tabular silver halide grains having an aspect ratio of at least 5, more preferably from 5 to less than 30, especially 5 to 25, account for at least 50% of the total projected area of silver halide grains in the emulsion. An average aspect ratio is preferably at least 5, more preferably from 5 to 20.

The proportion of tabular silver halide grains having an aspect ratio of at least 5 is preferably such that the sum of projected areas thereof is 50 to 100%, more preferably 70 to 100%, most preferably 90 to 100% of the sum of projected areas of all silver halide grains.

Such tabular silver halide grains can be prepared by properly combining known methods. Tabular grains having parallel twin crystal faces and {111} major faces can be readily prepared by referring to the methods described in JP-A 127927/1983, 113927/1983, and 113928/1983. In another useful method, seed crystals containing at least 40% by weight of tabular grains are formed in an atmosphere having a relatively low pBr value of 1.3 or less. The seed crystals are then grown by concurrently adding silver and halide solutions while maintaining an approximately equal pBr value. During the grain growth step, the silver and halide solutions are desirably added in such a controlled manner as to generate no new crystal nuclei. Tabular silver halide grains can be adjusted in size by controlling the temperature, the type and amount of a solvent, the addition rates of silver salt and halide used during grain growth, and other parameters.

Especially useful among the tabular silver halide grains are monodisperse hexagonal tabular grains. The structure and preparation of monodisperse hexagonal tabular grains are described in JP-A 151618/1988.

In the silver halide emulsion preferred in the practice of the invention, the crystal structure may be uniform or have a halide composition which is different between inner and outer portions or a layered structure. Also preferred are grains in which reduction sensitized silver nuclei have been introduced during grain formation.

In the practice of the invention, grains of the halogen conversion type are effectively utilized as described in BP 635,841 and U.S. Pat. No. 3,622,318. The amount of halogen conversion is preferably 0.05 to 0.45 mol %, more preferably 0.1 to 0.3 mol % of the molar amount of silver.

A higher sensitivity silver halide emulsion can be obtained by converting the surface of tabular silver halide grains into a high iodine type.

In the practice of the method mentioned above, halogen conversion is advantageously performed in the presence of a silver halide solvent. Preferred solvents are thioether compounds, thiocyanate salts, and tetra-substituted thioureas. Inter alia, thioether compounds and thiocyanate salts are effective. The thiocyanates and thioether compounds are preferably used in amounts of 0.5 to 5 g and 0.2 to 3 g per mol of the silver halide, respectively.

As the silver halide used herein, tabular grains having a silver chloride content of at least 20 mol % and an aspect ratio of at least 5 in which grains having {100} major faces account for at least 50% of the total projected area are also preferred.

Tabular grains having {100} major faces can be prepared in accordance with the methods described in JP-A 281640/1993, 313273/1993, 59360/1994, 308648/1994, 308649/1994, 146522/1995, 104430/1995, 225441/1995, 12954/1996, 122953/1996, and Japanese Patent Application No. 96883/1996.

With respect to the nucleation for tabular grains having {100} major faces, discussion is made in JP-A 204073/1993, 88017/1976, 24238/1988, 146522/1995, and Japanese Patent Application No. 262590/1994. In the practice of the invention, any of the nucleating methods described in these patents can be used.

Any of well-known methods may be used for growing silver halide grains according to the invention. That is, a silver salt aqueous solution and a halide salt aqueous solution are added to a reaction vessel with effective stirring. More illustratively, grains are prepared by the methods described in P. Glafkides, Chimie et Physique Photographique, Paul Montel, 1967, G. F. Duffin, Photographic Emulsion Chemistry, the Focal Press, 1966, V. L. Zelikman et al, Making and Coating Photographic Emulsion, the Focal Press, 1964, etc. Any of acidic, neutral, and ammonia methods may be used while the mode of reacting a soluble silver salt with a soluble halide salt may be any of single jet, double jet and a combination thereof.

One special type of the double jet technique is by maintaining constant the pAg of a liquid phase in which silver halide is created, which is known as a controlled double jet technique. It is also preferred to accelerate the growth of silver halide grains within the range not exceeding a critical supersaturation, using a method of changing the rates of addition of silver nitrate and alkali halide aqueous solutions in accordance with the rate of grain growth as described in BP 1,535,016, JP-B 36890/1973 and 16364/1977, or a method of changing the concentrations of aqueous solutions as described in U.S. Pat. No. 4,242,445 and JP-A 158124/1980.

Where the inventive grains have {100} major faces, the growth of tabular grains is preferably effected by adding $Ag^+$ salt and halide salt at such a rate that new nuclei generate, but do not grow to critical fine-grains. It is preferred that new nuclei are present in a number of grains at least 2 times, more preferably at least 5 times, most preferably at least 10 times, the number of {100} tabular grains. The occurrence of new nucleus generation is preferable because the generation of new nuclei prevents tabular grains from being dissolved and maintain anisotropic growth of grains. The supersaturation degree of the system is reduced by the generation of new nuclei, which is also effective for maintaining anisotropic growth of grains. The generation of new nuclei, the number of new nuclei, and non-generation of grains with a size in excess of the critical fine-grain size can be confirmed by direct TEM observation of a sample having not undergone centrifugation during its preparation. The rate of addition at which new nuclei generate, but do not grow the critical fine-grain size varies with the halogen composition added, pH, pAg, gelatin species, gelatin concentration, temperature, AgX solvent concentration, {100} tabular grain size, etc. Therefore, the rate of addition must be determined at different stages of growth by a trial-and-error procedure. Usually, the rate of addition satisfying the above conditions can be realized in a wider region of addition rate as the pCl value increases. It is preferred that the generation of new nuclei always occur although it suffices that new nuclei generate only at the time of addition in an amount of at least 5%, more preferably at least 10% of the amount of growing silver. Even in this case, there must always be present newly generated nuclei when the Ag salt is being added.

When the inventive grains have {100} major faces, it is also preferable that the growth of tabular grains is effected by physical ripening in the presence of silver halide fine-grains (wherein fine-grains are dissolved and tabular grains grow instead).

In the fine-grain emulsion addition method, an emulsion of AgX fine-grains having a diameter of up to 0.15 μm, preferably up to 0.1 82 m, more preferably 0.06 to 0.006 μm is added whereupon tabular grains grow by Ostwald ripening. The fine-grain emulsion may be added either continuously or discontinuously. The fine-grain emulsion can be continuously prepared by feeding a $AgNO_3$ solution and a $X^-$ salt solution into a mixer disposed in proximity to the reaction vessel whereupon the emulsion is continuously added to the reaction vessel immediately thereafter. Alternatively, the fine-grain emulsion can be prepared batchwise in a separate vessel and added either continuously or discontinuously. The fine-grain emulsion may be added either in liquid form or as dry powder. It is also possible to add dry powder in liquid form by mixing it with water immediately before addition. Fine grains are preferably added such that the fine grains disappear within 20 minutes, more preferably within 10 seconds to 10 minutes. If the disappearing time is longer, undesirable ripening can occur between fine grains to increase the grain size. Therefore, it is preferred that the entire amount is not added simultaneously. Preferably the fine grains are substantially free of multiple twin crystal grains. The multiple twin crystal grains used herein designate grains having at least two twin faces per grain. The term "substantially free" means that the number proportion of multiple twin crystal grains is less than 5%, preferably less than 1%, more preferably less than 0.1%. More preferably the fine grains are also substantially free of singlet twin crystal grains. Further preferably the fine grains are substantially free of spiral dislocation. The term "substantially free" used herein is as defined above.

Such fine grains have a halogen composition of AgCl, AgBr, AgBrI (preferably having a $I^-$ content of less than 10 mol %, more preferably less than 5 mol %) and mixed crystals of two or more. For the remaining detail, reference should be made to JP-A 59360/1994.

The total amount of fine grains added should be more than 20 mol %, preferably more than 40 mol %, more preferably 50 to 98 mol % of the overall silver halide amount.

The fine grains preferably have a Cl content of more than 10 mol %, more preferably 50 to 100 mol %.

Upon nucleation, ripening and growth, the dispersing medium used may be a conventional well-known dispersing medium for AgX emulsions. It is preferred to use gelatin having a methionine content of 0 to 50 μmol/g, more preferably 0 to 40 μmol/g. The use of gelatin upon ripening and growth is preferred because thinner tabular grains having a narrow diameter size distribution are formed. The preferred dispersing medium which can be used herein includes the synthetic polymers described in JP-B 16365/1977, Journal of Japanese Photographic Society, Vol. 29 (1), 17, 22 (1966), ibid., Vol. 30 (1), 10, 19 (1967), ibid., Vol. 30 (2), 17 (1967), ibid., Vol. 33 (3), 24 (1967). Upon growth by fine grain addition, the pH should be at least 2.0, preferably 6.0 to 10.0, more preferably 6.0 to 9.0.

Also, the pCl should be at least 1.0, preferably at least 1.6, more preferably 1.8 to 3.0.

These growth conditions are favorable especially for tabular grains having {100} major faces.

It is noted that pCl is defined as $$pCl=-\log[Cl^-]$$

wherein $[Cl^-]$ is the activity of Cl ion in the solution. Reference should be made to T. H. James, The Theory of The Photographic Process, 4th Ed., Ch. 1.

If the pH is lower than 2.0, in the case of tabular grains having {100} major faces, for example, the lateral growth is restrained to lower the aspect ratio, and the emulsion tends to lower the covering power and sensitivity. Above pH 2.0, the lateral growth rate becomes higher, and an emulsion having a high aspect ratio and covering power is obtained although the emulsion tends to have high fog and low sensitivity.

If the pCl is lower than 1.0, in the case of tabular grains having {100} major faces, for example, the vertical growth is promoted to lower the aspect ratio, and the emulsion tends to lower the covering power and sensitivity. If the pCl exceeds 1.6, the aspect ratio becomes higher and the covering power increases although the emulsion tends to have high fog and low sensitivity. If silver halide fine grains help tabular grains grow at this point, there result low fog, high sensitivity, high aspect ratio and high covering power even above pH 6 and/or pCl 1.6.

As the inventive tabular grains, silver halide grains having a dislocation line are preferably used.

The dislocation lines in tabular grains are described, for example, in J. F. Hamilton, Phot. Sci. Eng., 11, 57 (1967) and T. Shiozawa, J. Soc. Phot. Sci. Japan, 35, 213 (1972). Dislocation lines can be observed by a direct method using a transmission electron microscope at low temperature. More particularly, observation is carried out by taking silver halide grains out of an emulsion in such a careful manner as not to apply a sufficient pressure to cause to incur dislocation in grains, resting the grains on a mesh for electron microscope observation, and cooling the sample so as to prevent damages (printouts or the like) by electron beams. Since the transmission of electron beams through grains becomes more difficult as the thickness of grains is greater, a clearer observation is insured by the use of an electron microscope of the high voltage type (at least 200 kV for grains of 0.25 μm thick). From a photograph of grains obtained by this procedure, the position and number of dislocations in each grain as viewed in a direction perpendicular to the major face can be determined.

Also, in the step of formation or physical ripening of silver halide grains, a suitable salt may be co-present such as a cadmium salt, zinc salt, lead salt, thallium salt, iridium salt or complex salt, rhodium salt or complex salt, iron salt or complex salt.

According to the invention, the silver halide grains are subject to chemical sensitization. To this end, chalcogen sensitization such as sulfur, selenium or tellurium sensitization is used in combination with gold sensitization. Among these, selenium and/or tellurium sensitization is preferred. In combination with selenium and/or tellurium sensitization, another chalcogen sensitization such as sulfur sensitization or gold sensitization may be effected, with the combination of golf sensitization being especially preferred.

For the selenium sensitization, unstable selenium compounds are used as described in, for example, JP-B 13489/1968, 15748/1969, JP-A 25832/1992, 109240/1992, 271341/1992 and 40324/1993. More particularly, useful selenium compounds are, for example, colloidal metallic selenium, selenoureas (e.g., N,N-dimethylselenourea, trifluoromethylcarbonyl-trimethylselenourea, and acetyl-trimethylselenourea), selenoamides (e.g., selenoacetamide and N,N-diethylphenylselenoamide), phosphine selenides (e.g., triphenylphosphine selenide and pentafluorophenyl-triphenylphosphine selenide), selenophosphates (e.g., tri-p-tolylselenophosphate and tri-n-butylselenophosphate), selenoketones (e.g., selenobenzophenone), isoselenocyanates, selenocarboxylic acids, seleno esters, and diacylselenides. Also useful are non-unstable selenium compounds as described in JP-B 4553/1971 and 34492/1977, for example, selenites, potassium selenocyanide, selenazoles, and selenides.

For the tellurium sensitization, unstable tellurium compounds are used as described in, for example, Canadian Patent No. 800,958, BP 1,295,462, 1,396,696, JP-A 204640/1992, 271341/1992, 333043/1992 and 303157/1993. Examples of the tellurium compound include telluroureas (e.g., tetramethyltellurourea, N,N'-dimethyl-ethylenetellurourea, and N,N'-diphenylethylenetellurourea), phosphine tellurides (e.g., butyl-diisopropylphosphine telluride, tributylphosphine telluride, tributoxyphosphine telluride, and ethoxy-diphenylphosphine telluride), diacyl (di) tellurides (e.g., bis (diphenylcarbamoyl)-ditelluride, bis (N-phenyl-N-methylcarbamoyl) ditelluride, bis (N-phenyl-N-methylcarbamoyl) telluride, bis (N-phenyl-N-benzylcarbamoyl) telluride, and bis(ethoxycarbonyl)-telluride), isotellurocyanates, telluroamides, tellurohydrazides, telluroesters (e.g., butylhexyltelluro ester), telluroketones (e.g., telluroacetophenone), colloidal tellurium, (di) tellurides, and other tellurium compounds (e.g., potassium telluride and sodium telluro-pentathionate).

For the gold metal sensitization, gold salts may be used as described in the above-referred P. Grafkides, Chimie et Physique Photographique, 5th Ed., Paul Montel, 1987, and *Research Disclosure,* Vol. 307, No. 307105. Useful examples are chloroauric acid, potassium chloroaurate, potassium aurithiocyanate, gold sulfide, gold selenide and other gold compounds as described in U.S. Pat. Nos. 2,642,361, 5,049,484, and 5,049,485. Salts of noble metals such as platinum, palladium, and iridium may also be added.

For the sulfur sensitization, unstable sulfur compounds are used as described in, for example, P. Grafkides, Chimie et Physique Photographique, 5th Ed., Paul Montel, 1987, and *Research Disclosure,* Vol. 307, No. 307105. The unstable sulfur compounds used herein are well-known sulfur compounds, for example, thiosulfates (e.g., hypo), thioureas (e.g., diphenyithiourea, triethylthiourea, N-ethyl-N'-(4-methyl-2-thiazolyl) thiourea, and carboxymethyltrimethyl-thiourea), thioamides (e.g., thioacetamide), rhodanines (e.g., diethylrhodanine and 5-benzylidene-N-ethylrhodanine), phosphine sulfides (e.g., trimethyiphosphine sulfide), thiohydantoins, 4-oxo-oxazolidine-2-thiones, di- or poly-sulfides (e.g., dimorpholine disulfide, cystine, and lenthionine), mercapto compounds (e.g., cysteine), polythionates, and elemental sulfur as well as active gelatin.

The amount of the chalcogen sensitizer used herein is preferably about $10^{-8}$ to $10^{-2}$ mol, more preferably about $10^{-7}$ to $5\times10^{-3}$ mol per mol of the silver halide although it varies with the silver halide grains used and chemical sensitization conditions.

The amount of the gold sensitizer or noble metal sensitizer used herein is preferably about $10^{-7}$ to $10^{-2}$ per mol of the silver halide. No particular limits are imposed on the conditions of chemical sensitization although preferred conditions include pAg 6 to 11, more preferably pAg 7 to 10, pH 4 to 10, and a temperature of 40 to 95° C., more preferably 45 to 85° C.

For the reduction sensitization, well-known reducing compounds may be used as described in the above-referred P. Grafkides, Chimie et Physique Photographique, 5th Ed., Paul Montel, 1987, and *Research Disclosure,* Vol. 307, No. 307105. Useful examples are aminoiminomethanesulfinic acids (also known as thiourea dioxide), borane compounds (e.g., dimethylaminoborane), hydrazine compounds (e.g., hydrazine and p-tolylhydrazine), polyamine compounds (e.g., diethylenetriamine and triethylenetetramine), stannous chloride, silane compounds, reductones (e.g., ascorbic acid), sulfites, aldehydes, and hydrogen gas. Reduction sensitization may also be performed in an atmosphere of high pH or excess silver ion (known as silver ripening).

In the silver halide emulsion according to the invention, surfaces or parts of grains may be subject to halogen exchange in the chemical sensitization step. A method for effecting halogen exchange may use water-soluble bromide salts such as potassium bromide and sodium bromide or water-soluble iodide salts such as potassium iodide, alone or in combination. These salts may be added in the form of solids, aqueous solutions or gelatin dispersions. It is also preferable to add fine grains of silver halide such as silver bromide, silver iodobromide or silver iodide, alone or in combination. When the silver halide fine grains are added, they preferably have a mean equivalent circular diameter of up to 0.1 $\mu$m, more preferably up to 0.05 $\mu$m. The fine grains can be continuously prepared by feeding a silver nitrate solution and an aqueous solution of any alkali halide into a mixer disposed in proximity to the reaction vessel whereupon the reaction solution is continuously added to the reaction vessel immediately thereafter. Alternatively, the fine grains can be prepared batchwise in a separate vessel before they are added to the reaction vessel. If necessary, an ion or compound of a heavy metal such as iridium, rhodium or platinum may be contained in the silver halide fine grains.

It is preferred for a particular purpose that a salt of a metal ion be present during preparation of the emulsion according to the invention, for example, during grain formation, during desalting, during chemical sensitization and before coating. Where grains are doped with a metal ion, it is preferably added upon grain formation. Where a metal ion is used for the modification of a grain surface or as a chemical sensitizer, it is preferably added after grain formation and before the completion of chemical sensitization. Grains may be entirely doped. Alternatively, only the core or only the shell or only an epitaxial portion of grains or only tabular grains may be doped. The metals which can be used include Mg, Ca, Sr, Ba, Al, Sc, Y, LaCr, Mn, Fe, Co, Ni, Cu, Zn, Ga, Ru, Rh, Pd, Re, Os, Ir, Pt, Au, Cd, Hg, Tl, In, Sn, Pb, and Bi. These metals may be added in the form of salts which can be dissolved upon grain formation, for example, ammonium salts, acetate salts, nitrate salts, sulfate salts, phosphate salts, hydroxide salts, six-coordinate complex salts, and four-coordinate complex salts. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of coordinate compounds may be selected from halo, aquo, cyano, cyanate, thiocyanate, nitrosil, thionitrosil, oxo, and carbonyl ligands. These metal compounds may be used alone or in admixture of two or more.

It is sometimes useful to add chalcogen compounds as described in U.S. Pat. No. 3,772,031 during preparation of an emulsion. Besides S, Se and Te, there may be present cyanates, thiocyanates, selenocyanates, carbonates, phosphates and acetates.

The chemical sensitization may be performed in the presence of a so-called chemical sensitization aid. Useful chemical sensitization aids include compounds which suppress fog and increase sensitivity during chemical sensitization, for example, azaindenes, azapyridazines and azapyrimidines. Examples of the chemical sensitization aids and modifiers are described in U.S. Pat. Nos. 2,131,038, 3,411,914, 3,554,757, JP-A 126526/1983 and the above-referred Duffin, Photographic Emulsion Chemistry, pp. 138–143.

It is preferred to use an oxidizing agent for silver in the process of preparing the emulsion of the invention. The oxidizing agent for silver designates a compound which acts on metallic silver to convert it into a silver ion. Especially useful are those compounds which convert very fine silver grains produced in the silver halide grain forming step and chemical sensitization step as a by-product into silver ions. The thus created silver ion may form either a silver salt difficultly soluble in water such as silver halide, silver sulfide, and silver selenide or a silver salt easily soluble in water such as silver nitrate. The oxidizing agent for silver may be either inorganic or organic. Exemplary inorganic oxidizing agents include ozone, hydrogen peroxide and addition products thereof (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), oxyacid salts such as peroxyacid salts (e.g., $K_2S_2O_8$, $K_2C_2O_6$, and $K_2P_2O_8$), peroxy complex compounds (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O]$, permanganates (e.g., $KMnO_4$), and chromates (e.g., $K_2Cr_2O_7$), halogen atoms such as iodine and bromine, perhalogenoic acid salts (e.g., potassium periodate), high valence metal salts (e.g., potassium hexacyanoferrate), and thiosulfonates. Examples of the organic oxidizing agent include quinones such as p-quinone, organic peroxides such as peracetic acid and perbenzoic acid, and compounds releasing active halogen such as N-bromosuccinimide, chloramine T and chloramine B. In one preferred embodiment, the oxidizing agent for silver is combined with the above-mentioned reduction sensitizer.

Better results are obtained when the photographic emulsion of the invention is spectrally sensitized. The dyes useful for spectral sensitization include cyanine dyes, merocyanine dyes, complex cyanine dyes, complex merocyanine dyes, holopolar cyanine dyes, hemicyanine dyes, styryl dyes, and hemioxonol dyes. Particularly useful dyes among them are cyanine, merocyanine, and complex merocyanine dyes. To these dyes, any nuclei generally utilized for cyanine dyes can be applied as basic heterocyclic ring nuclei. For example, applicable are pyrroline nuclei, oxazoline nuclei, thiazolin nuclei, selenazoline nuclei, pyrrole nuclei, oxazole nuclei, thiazole nuclei, selenazole nuclei, imidazole nuclei, tetrazole nuclei, pyridine nuclei, tellurazole nuclei, etc.; and nuclei of the foregoing nuclei having a cycloaliphatic hydrocarbon ring fused thereto and nuclei of the foregoing nuclei having an aromatic hydrocarbon ring fused thereto, such as indolenine nuclei, benzindolenine nuclei, indole nuclei, benzoxazole nuclei, naphthoxazole nuclei, benzimidazole nuclei, naphthimidazole nuclei, benzothiazole nuclei, naphthothiazole nuclei, benzoselenazole nuclei, naphthoselenazole nuclei, quinoline nuclei, benzotellurazole nuclei, etc. These heterocyclic nuclei may be substituted on a carbon atom(s).

For the merocyanine and complex merocyanine dyes, those nuclei generally used for merocyanine dyes are applicable as a nucleus having a ketomethylene structure, for example, 5-or 6-membered heterocyclic nuclei such as a pyrazolin-5-one nucleus, thiohydantoin nucleus, 2-thiooxazolidine-2,4-dione nucleus, thiazolidine-2,4-dione nucleus, rhodanine nucleus, thiobarbituric acid nucleus, and 2-thioselenazolidine-2,4-dione nucleus.

These sensitizing dyes may be used alone or in combination. Combinations of sensitizing dyes are often used particularly for the purpose of supersensitization. Typical examples are found in the following patents.

| | | |
|---|---|---|
| USP 2,688,545 | 2,977,229 | 3,397,060 |
| 3,522,052 | 3,527,641 | 3,617,293 |
| 3,628,964 | 3,666,480 | 3,672,898 |
| 3,679,428 | 3,703,377 | 3,769,301 |
| 3,614,609 | 3,837,862 | 4,026,707 |
| BP 1,344,281 | 1,507,803 | |

-continued

| | |
|---|---|
| JP-B 4936/1968 | 12375/1978 |
| JP-A 110618/1977 | 109925/1977 |

These sensitizing dyes may be used in combination with any of dyes which themselves do not have spectral sensitization function and compounds which do not substantially absorb visible light, but enhance spectral sensitization when combined with the sensitizing dye, which are known as supersensitizers. Typical examples of the supersensitizer include bispyridinium salts as described in JP-A 142541/1984, stilbene derivatives as described in JP-B 18691/1984, water-soluble bromides and water-soluble iodides such as potassium bromide and potassium iodide as described in JP-B 46932/1974, condensation products of aromatic compounds and formaldehyde as described in U.S. Pat. No. 3,743,510, cadmium salts, and azaindenes.

The sensitizing dye may be added to the emulsion either before or after chemical ripening. Most preferably, the sensitizing dye is added to the silver halide grains during or before chemical ripening, for example, during grain formation or during physical ripening.

The spectral sensitizing dye may be introduced in the silver halide emulsion by directly dispersing the dye in the emulsion. It is also possible to dissolve the dye in a solvent and then add the solution to the emulsion. The solvents used herein include water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, and N,N-dimethylformamide alone or in admixture of two or more.

Several alternative methods are available as disclosed in U.S. Pat. No. 3,469,987 wherein a dye is dissolved in a volatile organic solvent, the solution is dispersed in water or hydrophilic colloid, and the dispersion is added to an emulsion; JP-B 24185/1971 wherein a water-insoluble dye is dispersed in a water-soluble solvent without dissolution, and the dispersion is added to an emulsion; JP-B 23389/1969, 27555/1969 and 22091/1982 wherein a dye is dissolved in an acid and the solution is added to an emulsion or a dye is dissolved in water to form an aqueous solution in the co-presence of an acid or base and the solution is added to an emulsion; U.S. Pat. Nos. 3,822,135 and 4,006,025 wherein an aqueous solution or colloidal dispersion of a dye in the co-presence of a surfactant is added to an emulsion; JP-A 102733/1978 and 105141/1983 wherein a dye is directly dispersed in hydrophilic colloid and the dispersion is added to an emulsion; and JP-A 74624/1976 wherein a dye is dissolved with the aid of a red-shifting compound and the solution is added to an emulsion. Ultrasonic waves may also be utilized to dissolve the dye.

Additionally, the photographic emulsion used herein may contain various additives for the purposes of preventing fog during preparation, shelf storage and photographic processing of the photosensitive element and stabilizing photographic performance. Useful additives include a number of compounds generally known as antifoggants and stabilizers, for example, thiazoles (e.g., benzothiazolium salts), nitroimidazoles, nitrobenzimidazoles, chlorobenzimidazoles, bromobenzimidazoles, mercaptothiazoles, mercaptobenzothiazoles, mercapbenzimidazoles, mercaptothiadiazoles, aminotriazoles, benzotriazoles, nitrobenzotriazoles, and mercaptotetrazoles (e.g., 1-phenyl-5-mercaptotetrazole); mercaptopyrimidines; mercaptotriazines; thioketo compounds (e.g., oxazolinethion); azaindenes, for example, triazaindenes, tetraazaindenes (e.g., 4-hydroxy-6-methyl-(1,3,3a,7)-tetraazaindene), and pentaazaindenes. For example, the compounds described in U.S. Pat. Nos. 3,954,474, 3,982,947 and JP-B 28660/1977 may be used. Other preferred compounds are described in Japanese Patent Application No. 47225/1987. Depending on a particular purpose, the antifoggants and stabilizers may be added at any desired stage, for example, before, during and after grain formation, during water washing, during dispersion after washing, before, during and after chemical sensitization, and before coating.

In the practice of the invention, it is preferred to effect chemical sensitization in the co-presence of a nucleic acid or decomposed product thereof before the end of chemical sensitization. The nucleic acids or decomposed products thereof used herein are described in JP-A 67541/1987. The nucleic acids include deoxyribonucleic acid (DNA) and ribonucleic acid (RNA), and the decomposed products of nucleic acids include partially decomposed products and adenine, guanine, uracil, cytocine, and thymine. Adenine is the most preferred decomposition product of nucleic acid. These may be used alone or in combination. Of course, a nucleic acid and a decomposition product of nucleic acid may be used in combination. The amount of the nucleic acid or decomposed product thereof added is preferably at least 20 mg, more preferably 100 mg to 1 g per mol of the silver halide although it varies with the type of nucleic acid or decomposed product thereof. When the nucleic acids or decomposed products thereof are used in admixture of two or more, their total amount may be the same as above.

In order to produce sharp images, the photosensitive element of the invention is provided with a crossover light cutting layer between the photosensitive emulsion layer and the support, if desired. To the crossover light cutting layer, a dye corresponding to the photosensitive wavelength region is added. Any desired dye may be used insofar as no detrimental absorption is left after development. The dye is often added in the form of a solid particle dispersion. The method of adding dyes in solid particle dispersion form is described, for example, in JP-A 264936/1990, 210553/1991, 210554/1991, 238447/1991, 14038/1992, 14039/1992, 125635/1992, 338747/1992, and 27589/1994. The dyes which can be used herein include dyes of the general formulae (I) to (VII) in JP-A 211542/1992, specifically Compounds I-1 to I-37, II-1 to II-6, III-1 to III-36, IV-1 to IV-16, V-1 to V-6, VI-1 to VI-13, and VII-1 to VII-5 illustrated therein; dyes of the general formula (1) in JP-A 73767/1996, specifically Compounds 1 to 6 illustrated therein; and dyes of the general formulae (VIII) to (XII) in JP-A 87091/1996, specifically Compounds VIII-1 to VIII-5, IX-1 to IX-10, X-1 to X-21, XI-1 to XI-6, and XII-1 to XII-7 illustrated therein.

Other useful methods include a method of causing well-known dyes to be adsorbed to mordants, a method of dissolving well-known dyes in oil followed by emulsifying dispersion like oil droplets, a method of causing dyes to be adsorbed on surfaces of inorganic materials as disclosed in JP-A 5748/1991, and a method of causing dyes to be adsorbed to polymers as disclosed in JP-A 298939/1990. The provision of the crossover light cutting layer to the photosensitive element may be carried out by the methods described in the above-referred patents.

To the photosensitive element of the invention, a dye may be added for enabling positional detection of the photosensitive element. The dye should preferably have an absorption spectrum corresponding to the maximum sensitivity wavelength of a detecting sensor although any dye that leaves no detrimental absorption after development may be used. Preferably dyes having maximum absorption at 700 to 1400 nm or particle dispersions thereof are used. Their examples are given below.

(1) Water-soluble dyes which will decolorize during processing include cyanine dyes, pyrylium dyes and aminium dyes of the general formulas (I) to (IV) in JP-A 211542/1991, for example, Compounds I-1 to I-6, II-1 to II-4, III-1 to III-4, and IV-1 to IV-5.

(2) Solid particle dispersible dyes which will decolorize during processing include cyanine dyes, pyrylium dyes and aminium dyes of the general formulas (I) to (IV) in JP-A 138640/1991, for example, Compounds I-1 to I-28, II-1 to II-10, III-1 to III-6, and IV-1 to IV-7.

(3) Dyes which will not decolorize during processing include tricarbocyanine dyes having a carboxyl group of the general formulas (I) and (II) in Japanese Patent Application No. 227983/1994, for example, Compounds 1 to 33 therein, tetracarbocyanine dyes having a carboxyl group of the general formulas (I) and (II) in Japanese Patent Application No. 279297/1994, for example, Compounds 1 to 19 therein, cyanine dyes free of an acid group of the general formulas (1) to (3) in Japanese Patent Application No. 208569/1995, for example, Compounds 1 to 63 therein, and lake type cyanine dyes of the general formula [1] in Japanese Patent Application No. 135118/1995, for example, Compound Nos. 1 to 37 therein.

Other useful dyes which can be used herein include the pyrylium dyes described in JP-A 299959/1987, the light scattering particles described in JP-A 131135/1988, the cyanine dyes described in JP-A 266536/1989, the solid particle dispersions of oxonol dyes described in JP-A 282244/1990, the holopolar cyanine dyes described in JP-A 136038/1991, the polymeric cyanine dyes described in JP-A 253639/1995, the tin-doped indium oxide (ITO) powder described in JP-A 113072/1995, and the $Yb^{3+}$ compounds described in JP-A 151380/1995.

In adding the dye to the photosensitive element for the purpose of positional detection of the photosensitive element, the methods described in the above-referred patents may be utilized.

In the photosensitive element of the invention, colloidal silica may be contained. The colloidal silica preferably has a mean particle size of 1 to 1,000 nm, more preferably 5 to 500 nm, most preferably 5 to 100 nm. The colloidal silica contains silicon dioxide as a major component and may contain an alumina or sodium alginate as a minor component. Commercially available examples of the colloidal silica include Snowtex 20, Snowtex 30, Snowtex C, and Snowtex 0 by Nissan Chemical K.K.

In the photosensitive element of the invention, the layer to which colloidal silica is added may be any of hydrophilic colloid layers including a surface protective layer, intermediate layer, silver halide emulsion layer, antihalation layer, subbing layer, filter layer, and backing layer. Particularly when colloidal silica is added for imparting pressure resistance, it is preferably added to the surface protective layer or silver halide emulsion layer.

The amount of the colloidal silica contained is preferably 1 to 200% by weight, more preferably 10 to 100% by weight of the weight of hydrophilic colloid in the hydrophilic colloid layer.

If desired and preferably, a plastic polymer latex is additionally contained in the colloidal silica-containing layer.

Any of the layers in the photographic photosensitive element according to the invention may contain a polymer latex resulting from polymerization of a substantially water-insoluble monomer. The monomer used herein includes esters of acrylic acids, esters of methacrylic acids and divinyl benzene as described in JP-A 230135/1995, page 2, right column, lines 5–17. The polymer latex may also be obtained by copolymerizing the above monomer with another monomer. The other monomer used herein includes the monomers described in JP-A 230135/1995, page 2, right column, line 32 to page 4, left column, line 35. Of these, acrylates, methacrylates, vinyl esters, styrenes, and olefins are preferable. Examples of the polymer latex are Lx-1 to Lx-21 described in JP-A 230135/1995.

It is preferred in the invention to use matte agents designated Nos. 1 to 8 in Example 1 of JP-A 194779/1994. Compounds 1 to 9 described at [0023] in JP-A 138572/1994 are also preferably used. With respect to the size and other parameters of the matte agent, it may be used with the size and amount described at [0049] in JP-A 194779/1994. A mixture of matte agents having different particle sizes is also useful. With respect to the particle size distribution of the matte agent, monodisperse particles having a coefficient of variation of 3 to 30% or polydisperse particles having a coefficient of variation of more than 30% may be used depending on a particular purpose.

In the silver halide photographic element of the invention, the amount of the emulsion coated is up to 2.0 g calculated as silver per square meter on one side, preferably 0.5 to 1.7 $g/m^2$, more preferably 0.8 to 1.5 $g/m^2$.

In the photosensitive element of the invention, the total amount of gelatin coated in hydrophilic colloid layers is up to 2.5 g per square meter on one side, preferably 0.5 to 2.5 $g/m^2$, more preferably 1.0 to 2.1 $g/m^2$. The amount of gelatin coated in the protective layer is preferably 0.2 to 1.0 $g/m^2$.

The photosensitive element of the invention preferably has a swelling factor of 20% to 220%, more preferably 40% to 150%. The swelling factor is determined by measuring the thickness (a) of a dry sample, immersing the sample in distilled water at 21° C. for 3 minutes, measuring the thickness (b) of the swollen sample, and calculating in accordance with $(b-a)/a\times100\%$.

In general, the silver halide photographic element of the invention is prepared by applying onto a support an aqueous coating solution using a hydrophilic colloid such as gelatin as a binder, cooling the coating in cool air at a dry-bulb temperature of −10° C. to 20° C. for solidification, and then drying the coating at an elevated temperature. Usually, the weight ratio of gelatin to water immediately after coating is about 3,000%.

In the coating solution, there are usually contained a hydrophilic colloid binder, silver halide grains, surfactant, plasticizer such as polymer latex, gelatin hardener, dye, sensitizing dye, matter agent, and other addenda.

In the practice of the invention, after the hydrophilic colloid layer coating solution is coated, the coating is preferably dried at a wet-bulb temperature of lower than 20° C., more preferably 19° C. to 10° C. until its water content is reduced below 100% based on the dry weight of binder in all coated layers on the silver halide emulsion layerbearing bearing side. Where two or more hydrophilic colloid layers are concurrently coated and dried (that is, there are two or more coatings to be dried), the water content is the sum of water contents in all layers and the dry weight of binder is the sum of dry weights of binder in all layers. The wet-bulb temperature is the temperature of a water droplet in equilibrium in humid air. The wet-bulb temperature becomes lower as the humidity of air becomes lower. In a constant rate drying duration of the drying step, the wet-bulb temperature of drying air is approximately equal to the surface temperature of a coated sample.

The coating and drying steps are followed by a roll winding step which is preferably performed in an environment at an absolute humidity of less than 1.4% by weight, more preferably 1.3 to 0.6% by weight.

In the practice of the invention, the silver halide photographic element which is wound in roll form after coating and drying is processed into a product, preferably in an environment at an absolute humidity of less than 1.4% by weight, more preferably 1.3 to 0.6% by weight. The absolute humidity (in % by weight) represents the state of humid air and is given as a percentage of the ratio of the amount (kg) of water vapor in humid air to the amount (kg) of dry air in humid air. When the silver halide photographic element is contained in a moisture-proof package and its opening is sealed as by heat sealing so that an absolute humidity of less than 1.4% by weight, more preferably 1.1 to 0.6% by weight may be established within the package, the photosensitive element reaches equilibrium at that absolute humidity. This is the processing environment.

It is recommended that the photosensitive element as processed is seasoned in an environment with an absolute humidity of up to 1.4% by weight before it is heat sealed in a package in the same environment.

No particular limits are imposed on the various addenda used in the photosensitive element of the invention. Use may be made of the additives described in JP-A 68539/1990 at the following pages, for example.

| | Components | JP-A 68539/1990 |
|---|---|---|
| 1 | Silver halide emulsion and its preparation | P8;LR,L25-P10,UR,L12 |
| 2 | Chemical sensitization | P10,UR,L13-LL,L16 |
| 3 | Antifoggant, stabilizer | P10,LL,L17-P11,UL,L7 + P3,LL,L2-P4,LL |
| 4 | Spectral sensitizing dye | P4,LR,L4-P8,LR |
| 5 | Surfactant, antistatic agent | P11,UL,L14-P12,UL,L9 |
| 6 | Matte agent, lubricant, plasticizer | P12,UL,L10-UR,L10 + P14,UL,L10-LR,L1 |
| 7 | Hydrophilic colloid | P12,UR,L11-LL,L16 |
| 8 | Hardener | P12,LL,L17-P13,UR,L6 |
| 9 | Support | P13,UR,L7-20 |
| 10 | Dyestuff, mordant | P13,LR,L1-P14,LL,L9 |

(Note: P: page, UL: upper left column, UR: upper right column, LL: lower left column, LR: lower right column, L: line)

Screen

In forming images using the photographic photosensitive element of the invention, radiographic exposure is preferably performed by combining the photosensitive element with a fluorescent intensifying screen using the following fluorescent substance.

Blue-luminescent fluorescent substances:

$Y_2O_2S$:Tb, LaOBr:Tb, BaFCl:Eu

Green-luminescent fluorescent substances:

$Gd_2O_2S$:Tb, $LaO_2S$:Tb

Typical UV-luminescent fluorescent substances include M' phase $YTaO_4$ alone or having added thereto Gd, Bi, Pb, Ce, Se, Al, Rb, Ca, Cr, Cd or Nb; LaOBr having added thereto Gd, Tm, Gd and Tm, Gd and Ce, or Tb; HfZr oxide alone or having added thereto Ge, Ti or alkali metal; $Y_2O_3$ alone or having added thereto Gd or Eu; $Y_2O_2S$ having added thereto Gd; and various fluorescent substances having Gd, Tl or Ce added as an activator. Preferred are M' phase $YTaO_4$ alone or having added thereto Gd or Sr; LaOBr having added thereto Gd, Tm, or Gd and Tm; HfZr oxide alone or having added thereto Ge, Ti or alkali metal.

The fluorescent substance preferably has a mean particle size of 1 to 20 $\mu$m although the particle size may be altered in accordance with the desired sensitivity and preparation conditions. The coating weight of the fluorescent substance is preferably 400 to 2,000 g/m$^2$ although it may be altered in accordance with the desired sensitivity and image quality. A single intensifying screen may be provided with a particle size distribution varying from near the support to the surface. In this regard, it is generally known that larger particles are distributed at the surface. The fluorescent substance usually has a space packing factor of more than 40%, preferably more than 60%.

Where photographing is done with fluorescent layers disposed on opposite surfaces of the photosensitive element, the coating weight of fluorescent substance on the X-ray incident side may be different from the coating weight of fluorescent substance on the opposite side. In consideration of shielding by the intensifying screen on the X-ray incident side, it is known to reduce the coating weight of the intensifying screen on the X-ray incident side where a high sensitivity system is necessary.

The support of the screen used herein may be paper, metal plates and polymer sheets. Most often, flexible sheets of polyethylene terephthalate or the like are used. If necessary, a reflective agent or light-absorbing agent may be added to the support, or the support may be provided on the surface with a layer of a reflective agent or light-absorbing agent.

Also if necessary, the support may be provided on the surface with fine asperities or undercoated with an adhesive layer for increasing adhesion to a fluorescent layer or a conductive layer. Exemplary reflective agents include zinc oxide, titanium oxide, and barium sulfate while titanium oxide and barium sulfate are preferred because of the short luminous wavelength of the fluorescent substance. The reflective agent may be contained not only in the support or between the support and the fluorescent layer, but also in the fluorescent layer. Where the reflective agent is contained in the fluorescent layer, it is preferably localized near the support.

Examples of the binder used in the screen according to the invention include naturally occurring high molecular weight substances, for example, proteins such as gelatin, polysaccharides such as dextran and corn starch, and gum arabic; synthetic polymers, for example, polyvinyl butyral, polyvinyl acetate, polyurethane, polyalkyl acrylate, vinylidene chloride, nitrocellulose, fluorinated polymers, and polyesters, and mixtures and copolymers thereof. The preferred binder should have a high transmittance of light emitted by the fluorescent substance as a basic function. Preferred in this regard are gelatin, corn starch, acrylic polymers, fluorinated olefin polymers, polymers containing fluorinated olefin as a comonomer, and styrene/acrylonitrile copolymers. These binders may have a functional group crosslinkable with a crosslinking agent. Depending on the desired image quality, an agent for absorbing light emission from the fluorescent substance may be added to the binder or a low transmittance binder may be used. Exemplary absorbing agents are pigments, dyestuffs and UV absorbing compounds. The volume ratio of fluorescent substance to binder is generally from 1:5 to 50:1, preferably from 1:1 to 15:1. The ratio of fluorescent substance to binder may be constant or varied in a thickness direction.

The fluorescent layer is generally formed by dispersing a fluorescent substance in a binder solution and applying the coating dispersion. The solvent for the coating solution may be water or organic solvents such as alcohols, chlorinated hydrocarbons, and ketone, ester, and ether aromatic compounds alone or in admixture of two or more. The coating solution may further contain agents for stabilizing the dispersion of fluorescent particles (dispersion stabilizers) such as phthalic acid, stearic acid, caproic acid and surfactants and plasticizers such as phosphates, phthalates, glycolates, polyesters, and polyethylene glycol.

The screen used herein may be further provided with a protective layer on the fluorescent layer. The protective layer is generally formed by coating a protective solution on the fluorescent layer or by separately forming a protective film and laminating it. In the coating method, the protective layer may be coated at the same time as the fluorescent layer or after the fluorescent layer is coated and dried. The protective layer may use a material which is identical with or different from the binder of the fluorescent layer. The materials used in the protective layer include the materials exemplified as the binder of the fluorescent layer as well as cellulose derivatives, polyvinyl chloride, melamine, phenolic resins, and epoxy resins. Preferred materials are gelatin, corn starch, acrylic polymers, fluorinated olefin polymers, polymers containing fluorinated olefin as a comonomer, and styrene/acrylonitrile copolymers. The protective layer generally has a thickness of 1 to 20 $\mu$m, preferably 2 to 10 $\mu$m, more preferably 2 to 6 $\mu$m. The protective layer is preferably embossed on the surface. A matte agent may be present in the protective layer, and a material capable of scattering emitted light, for example, titanium oxide may be contained in the protective layer in accordance with the desired image quality.

Surface lubricity may be imparted to the protective layer of the screen used herein. Preferred lubricants are polysiloxane skeleton-containing oligomers and perfluoro-alkyl-containing oligomers.

Electric conductivity may be imparted to the protective layer of the screen used herein. Useful conductive agents include white and transparent inorganic conductive materials and organic antistatic agents. Preferred inorganic conductive materials include ZnO powder and whiskers, $SnO_2$, and tin-doped indium oxide (ITO).

Development

For the processing of the photosensitive element of the invention, reference is made to U.S. Pat. No. 5,498,511, JP-A 16832/1995, 54712/1996, Japanese Patent Application Nos. 168670/1996 and 198401/1996. Broadly, the processing includes development, fixation and water washing.

The developer used in processing of the photosensitive element of the invention preferably contains as a developing agent hydroquinone, ascorbic acid or erythorbic acid (which is a diastereomer of ascorbic acid) and/or derivatives thereof. The ascorbic acid and/or derivatives thereof used herein are described in U.S. Pat. No. 2,688,549, JP-B 17599/1961, JP-A 249756/1991, and 270343/1992. More illustratively, the compounds described in U.S. Pat. No. 2,688,549, page 1, column 1, line 22 to column 2, line 33, the compounds described in JP-B 17599/1961, page 1, left column, lines 21–26, Compounds I-1 to I-8 and II-1 to II-4 described in JP-A 249756/1991, page 4, and the compounds described in JP-A 270343/1992, page 4, column 5, lines 40–50. Preferred among these are ascorbic acid or erythorbic acid (which is a diastereomer of ascorbic acid) and alkali metal salts thereof such as lithium, sodium and potassium salts. The developing agent is preferably contained in an amount of 0.01 to 0.8 mol/liter, more preferably 0.1 to 0.4 mol/liter.

It is desirable in the practice of the invention to use an auxiliary developing agent exhibiting superadditivity in admixture with the developing agent. The auxiliary developing agent exhibiting superadditivity includes 1-phenyl-3-pyrazolidones and p-aminophenols.

Non-limiting examples of the 1-phenyl-3-pyrazolidone used herein as the auxiliary developing agent include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone, with the 1-phenyl-4-methyl-4-hydroxymethyl-3-pyrazolidone being preferred. Where 1-phenyl-3-pyrazolidones are used as an auxiliary developing agent in combination with the developing agent, it is preferred to use 0.001 to 0.1 mol/liter, especially 0.005 to 0.05 mol/liter of the auxiliary developing agent.

Non-limiting examples of the p-aminophenol used herein as the auxiliary developing agent include N-methyl-p-amino-phenol, N-(β-hydroxyethyl)-p-aminophenol, N-(4-hydroxy-phenyl)glycine, 2-methyl-p-aminophenol, and p-benzylamino-phenol, with the N-methyl-p-aminophenol being preferred.

Where p-aminophenols are used as an auxiliary developing agent in combination with the developing agent, it is preferred to use 0.001 to 0.1 mol/liter, especially 0.005 to 0.05 mol/liter of the auxiliary developing agent.

Antifoggants are added to the developer. Exemplary antifoggants include azoles such as benzothiazolium salts, benzoimidazolium salts, imidazoles, benzimidazoles, nitroindazoles, triazoles, benzotriazoles, tetrazoles, and triazines, and mercapto compounds such as mercaptothiazoles, mercaptobenzothiazoles, mercaptoimidazoles, mercapto-benzimidazoles, mercaptobenzoxazoles, mercaptothiazoles, mercaptooxadiazoles, mercaptotetrazoles, mercapto-pyrimidines, and mercaptotriazines. Exemplary benzotriazoles are 5-methylbenzotriazole, 5-bromobenzotriazole, 5-chlorobenzotriazole, 5-butylbenzotriazole, and benzotriazole. Exemplary nitroindazoles are 5-nitroindazole, 6-nitroindazole, 4-nitroindazole, 7-nitroindazole, and 3-cyano-5-nitroindazole.

An anti-sludging agent may be contained in the developer. Use may be made of the compounds described in JP-B 46585/1981, 4702/1987, and 4703/1987, U.S. Pat. Nos. 4,252,215 and 3,318,701, JP-A 203439/1983, 56959/1987, 178247/1987, 200249/1989, 503179/1993, and 53257/1993.

As fixation promoters, mention may be made of the thio urea derivatives described in JP-B 35754/1970, JP-A 122535/1983 and 122536/1983, alcohols having a triple bond in a molecule, the thio ethers described in U.S. Pat. No. 4,126,459, cyclodextran ethers for rendering anions free, crown ethers, diazacycloundecene and di(hydroxyethyl) butamine. The mesoionic compounds described in JP-A 5654/1995 and 273898/1994 may also be used.

Anti-bacterial means is preferably applied to washing water or stabilizing solution. The anti-bacterial means includes irradiation of ultraviolet radiation as disclosed in JP-A 263939/1985; application of a magnetic field as disclosed in JP-A 263940/1985; the use of ion-exchange resins to purify water as disclosed in JP-A 131632/1986; and anti-bacterial agents as disclosed in JP-A 115154/1987, 153952/1987, 220951/1987 and 209532/1987. Also useful are anti-fungal agents, anti-bacterial agents and surfactants as described in L.F. West, "Water Quality Criteria", Photo.

Sci. & Eng., Vol. 9, No. 6 (1965); M. W. Beach, "Microbiological Growths in Motion-Picture Processing", SMPTE Journal, Vol. 85 (1976); R. O. Deegan, "Photo Processing Wash Water Biocides", J. Imaging Tech., 10, No. 6 (1984); and JP-A 8542/1982, 58143/1982, 97530/1982, 132146/1982, 157244/1982, 18631/1983, 105145/1983, 118583/1994, and 248589/1996.

In the washing and stabilizing baths, there may be added as microbiocides the isothiazolines described in R. T. Kreiman, J. Image, Tech 10 (6), 242 (1984), the isothiazolines described in *Research Disclosure,* Vol. 205, No. 20526 (May 1981), the isothiazolines described in *Research Disclosure,* Vol. 228, No. 22845 (April 1983), and the compounds described in JP-A 209532/1987. Other useful compounds are described in Horiguchi, Hiroshi, "Bokin Bobai no Kagaku", Sankyo Publishing K.K., 1982, and Nippon Bokin Bobai Society, "Bokin Bobai Gijutu Handbook (Antifungal & Antibacterial Engineering Handbook)", Hakuhodo K.K., 1986.

Overflow solution exits from the washing or stabilizing bath as water having any anti-bacterial means applied thereto is replenished with the progress of processing. Part or all of the overflow solution may be used as a processing solution having a fixing function in the preceding step as disclosed in JP-A 235133/1985.

In the processing system, the amount of solution carried over from the developing tank to the fixing tank and from the fixing tank to the washing tank is preferably 0.01 to 2 ml, more preferably 0.1 to 1.2 ml, most preferably 0.1 to 0.8 ml per sheet sized 10×12 inches. In the case of a multi-stage washing tank, the amount of water carried over from one washing tank to the next washing tank is preferably 0.01 to 2 ml, more preferably 0.1 to 1.2 ml, most preferably 0.1 to 0.8 ml per sheet sized 10×12 inches. The amount of water carried over from the washing tank to the drying zone is preferably 0.01 to 2 ml, more preferably up to 1 ml, most preferably up to 0.5 ml per sheet sized 10×12 inches.

According to the invention, the photosensitive element is adapted for rapid processing. By the rapid processing it is meant that the overall processing time taken from the entry of photosensitive element into a developer to the end of drying step, that is, dry-to-dry processing time is up to 90 seconds, preferably 5 to 60 seconds. In general, development is done at 25 to 40° C. for 5 to 30 seconds, fixation at 25 to 40° C. for 5 to 40 seconds, water washing at 0 to 40°C. for 5 to 30 seconds, and drying at 40 to 120° C. for 1 to 30 seconds. The developer, fixer and washing water are replenished in an amount of 30 to 650 ml, 30 to 650 ml, and 30 to 50,000 ml per square meter of the photosensitive element, respectively.

With respect to the detail of processing, reference should be made to Japanese Patent Application No. 168670/1996.

EXAMPLE

Examples of the invention are given below by way of illustration and not by way of limitation. TEM is a transmission electron microscope, and Mw is an average molecular weight.

Example 1

Emulsion A: Preparation of High Aspect Ratio (111) AgBr Tabular Grains

In a reactor, 6.0 g of potassium bromide and 7.0 g of low-molecular weight gelatin having an average molecular weight of 15,000 were added to 1 liter of water. With stirring at 55° C., 37 ml of an aqueous solution containing 4.00 g of silver nitrate and 38 ml of an aqueous solution containing 5.9 g of potassium bromide were added over 37 seconds by the double jet method. After 18.6 g of gelatin was added, the solution was heated to 70° C. and 89 ml of an aqueous solution containing 9.80 g of silver nitrate was added over 22 minutes. Then 7 ml of 25% ammonia water was added, the solution was physically ripened for 10 minutes at the temperature, and 6.5 ml of a 100% acetic acid solution was added. Subsequently, an aqueous solution containing 153 g of silver nitrate and an aqueous solution of potassium bromide were added over 35 minutes by the controlled double jet method while maintaining the solution at pAg 8.5. Then 15 ml of a 2N potassium thiocyanate solution was added to the solution. After physical ripening for 5 minutes at the temperature, the temperature was lowered to 35° C.

A TEM image of a replica of the grains was observed to determine configurational characteristics. There were obtained monodisperse pure silver bromide tabular grains having (the total projected area of tabular grains having an aspect ratio of at least 5)/(the sum of projected areas of entire AgX grains)×100=a1=95%, an average aspect ratio (average diameter/average thickness) of tabular grains=a2=10.0, an average diameter of tabular grains=a3=1.50 $\mu$m, an average thickness of tabular grains=a4=0.15 $\mu$m, and a coefficient of variation of diameter of 18.5%.

The soluble salts were then removed by sedimentation. After the emulsion was heated at 40° C. again, 30 g of gelatin, 2.35 g of phenoxyethanol, and 0.8 g of sodium polystyrenesulfonate as a thickener were added to the emulsion, which was adjusted to pH 5.90 and pAg 8.00 with solutions of sodium hydroxide and silver nitrate.

Chemical Sensitization

Emulsion A prepared above was subject to chemical sensitization while keeping at 57° C. with stirring. First, Thiosulfonic Acid Compound I was added in an amount of $1\times10^{-4}$ mol per mol of the silver halide. Then AgI fine grains having a diameter of 0.03 $\mu$m were added in an amount of 0.15 mol % based on the total silver amount. After 3 minutes, $1\times10^{-6}$ mol/mol of Ag of thiourea dioxide was added to the emulsion, which was kept at the temperature for 22 minutes for reduction sensitization. Then, 4-hydroxy-6-methyl-1,3,3a,7-tetraazaindene in an amount of $3\times10^{-4}$ mol per mol of the silver halide and dispersions of Sensitizing Dyes 1, 2, and 3 were concurrently added. The amount of Sensitizing Dye 1 added was $1.0\times10^{-3}$ mol per mol of the silver halide, the amount of Sensitizing Dye 2 added was $1.2\times10^{-5}$ mol per mol of the silver halide, the amount of Sensitizing Dye 3 added was $2.4\times10^{-4}$ mol per mol of the silver halide. Finally, calcium chloride was added.

Subsequently, sodium thiosulfate in an amount of $6\times10^{-6}$ mol per mol of the silver halide and Selenium Compound 1 in an amount of $4\times10^{-6}$ mol per mol of the silver halide were added, whereupon chloroauric acid in an amount of $1\times10^{-5}$ mol per mol of the silver halide and potassium thiocyanate in an amount of $2\times10^{-3}$ mol per mol of the silver halide were added. Further, a nucleic acid (trade name RNA-F by Sanyo Kokusaku Pulp K.K.) was added in an amount of 67 mg per mol of the silver halide. After 40 minutes, water-soluble Mercapto Compound 1 was added in an amount of $1\times10^{-4}$ mol per mol of the silver halide. The emulsion was cooled to 35° C., terminating chemical sensitization of the emulsion.

Thiosulfonic Acid Compound I $C_2H_5SO_2SNa$

Sensitizing Dye 1

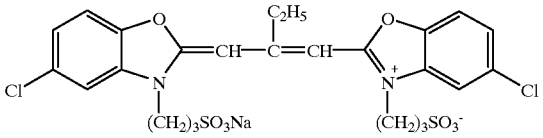

Sensitizing Dye 2

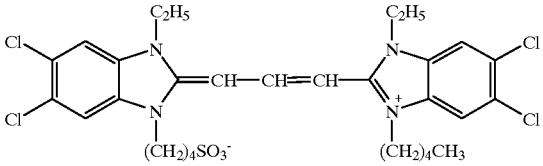

Sensitizing Dye 3

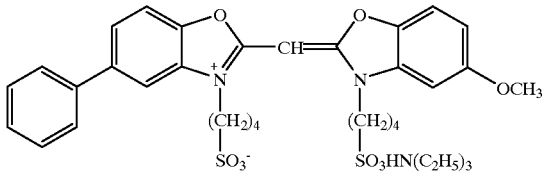

Selenium Compound 1

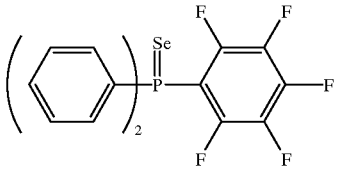

Mercapto Compound 1

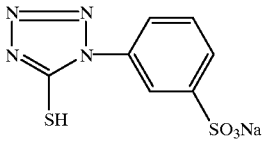

Preparation of Dispersions of Sensitizing Dyes 1, 2 and 3

Using a dissolver at 2,000 to 2,500 rpm, 1 g of each sensitizing dye was mechanically dispersed in 50 ml of water at pH 7.0±0.5 and a temperature of 50 to 65° C. as solid particles with a size of less than 1 μm. Then 50 g of 10% gelatin was added to the dispersion, which was mixed and cooled.

Preparation of Pigment Dispersions A, B and C (invention)

Dispersions of Microlithblue A3R-K (C.I. Pigment Blue 60), Microlithblue 4G-K (C.I. Pigment Blue 15:3) and Microlithviolet B-K (C.I. Pigment Violet 37) by Ciba Geigy, designated Dispersions A, B, and C, respectively, were prepared as follows. By applying ultrasonic waves, 1.8 g of each pigment, 48.8 g of ethyl acetate, 1.8 g of High-Boiling Organic Solvent I, and 1.44 g of a 72% aqueous solution of sodium dodecylbenzenesulfonate were dispersed at 50° C. Then 7.2 g of gelatin, 0.72 g of a 3.5% aqueous solution of proxisel, and 104.4 ml of water were added. By operating a homogenizer at 12,000 rpm, the contents were emulsified and dispersed at 50° C. for 8 minutes. After the ethyl acetate was evaporated off by means of a rotary evaporator, water was added so as to give a total weight of 180 g and the temperature was lowered, obtaining a pigment dispersion.

High-Boiling Organic Solvent I

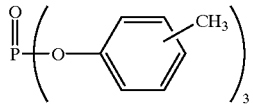

Preparation of Pigment Dispersions D, E and F (comparison)

A solution containing 20% by weight of C.I. Pigment Blue 60, C.I. Pigment Blue 15 or C.I. Pigment Violet 23 and 10% by weight of Demor N (Kao Atlas K.K.) as a dispersant was dispersed in a sand mill, obtaining a water dispersion of the pigment having a mean particle size of 0.15 μm. They are designated Pigment Dispersions D, E and F.

Preparation of Dye Emulsion (a)

Dye-1, 60 g, was dissolved in 62.8 g of 2,4-diaminophenol, 62.8 g of dicyclohexyl phthalate, and 333 g of ethyl acetate at 60° C. To the solution were added 65 ml of a 5% aqueous solution of sodium dodecylbenzenesulfonate, 94 g of gelatin, and 581 ml of water. The mixture was emulsified and dispersed for 30 minutes at 60° C. by means of a dissolver. Then 2 g of methyl p-hydroxybenzoate and 6 liters of water were added to the dispersion, which was cooled to 40° C. Using a ultrafiltration Labomodule ACP1050 by Asahi Chemicals K.K., the dispersion was concentrated to a total amount of 2 kg. Addition of 1 g of methyl p-hydroxybenzoate to the dispersion yielded dye emulsion (a).

Dye-1

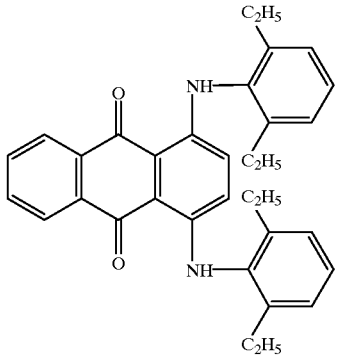

Preparation of Emulsion Coating Solution

An emulsion coating solution was prepared by adding the following chemicals to the chemically sensitized emulsion in amounts per mol of the silver halide.

| | |
|---|---|
| Gelatin (inclusive of gelatin in emulsion) | 80.6 g |
| Dextran (Mw 39,000) | 21.5 g |
| Sodium polyacrylate (Mw 400,000) | 5.1 g |
| Sodium polystyrenesulfonate (Mw 600,000) | 1.2 g |
| Potassium iodide | 78 mg |

Hardener: 1,2-bis(vinylsulfonylacetamide) ethane an amount to give a swelling factor of 140%

Further, the following Compounds I to VII were added in the following amounts.

| | |
|---|---|
| Compound I | 70 mg |
| Compound II | 5.0 g |
| Compound III | 0.58 g |
| Compound IV | 30 mg |
| Compound V | 6.0 mg |

Compound I

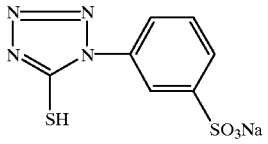

Compound II

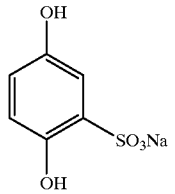

Compound III

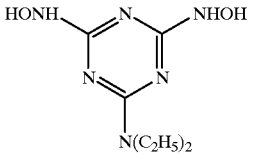

Compound IV

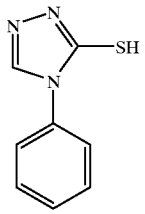

Compound V

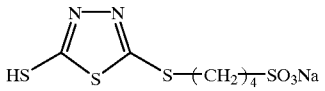

Compound VI

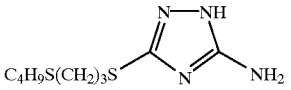

-continued

Compound VII

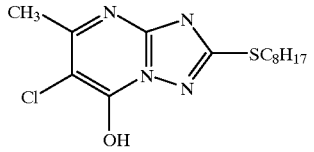

Further, the following polymer latex having an active methylene group was added in such an amount as to give a coverage of 0.8 g/m$^2$.

Polymer latex:

Core: styrene/butadiene (37/63 wt %) copolymer

Shell: styrene/2-acetoacetoxyethyl methacrylate (84/16 wt %) copolymer

Core/shell=50/50 wt % adjusted to pH 6.1 with NaOH

Preparation of Dye Layer Coating Solution

A dye layer coating solution was prepared such that a dye layer to be coated under the emulsion layer might contain respective components in the following coverages.

| | |
|---|---|
| Gelatin | 0.25 g/m$^2$ |
| Additive D | 1.4 mg/m$^2$ |
| Sodium polystyrenesulfonate (Mw 600,000) | 5.9 mg/m$^2$ |
| Dye dispersion (i) (as dye solids) | 20 mg/m$^2$ |

Preparation of Dye Dispersion (i)

Dye II shown below was used as a wet cake without drying and weighed so as to give 6.3 g of dry solids. Dispersant V shown below was used as a 25 wt % aqueous solution and added to the wet cake of dye in such an amount as to give a dry solid amount corresponding to 30% by weight of the dye solids. Water was added to a total weight of 63.3 g and the mixture was thoroughly agitated to form a slurry. The slurry was admitted into a vessel together with 100 ml of zirconia beads with a mean diameter of 0.5 mm. A dispersing machine 1/16G sand grinder mill (Imex K.K.) was operated for 6 hours for dispersion. Water was added to the dispersion so as to give a dye concentration of 8% by weight, yielding a dye dispersion.

This dispersion was mixed with photographic gelatin such that the dye solid content was 5% by weight and the content (in % by weight) of gelatin was equal to the dye solid content. An aqueous solution of Additive D shown below as an antiseptic agent was added to the dispersion in such an amount that Additive D was 2,000 parts by weight per million parts by weight of gelatin. The dispersion was refrigerated and stored in jelly form.

In this way, Dye Dispersion (i) was obtained as an undissolvable solid particle dispersion having a light absorption peak at 915 nm. Solid particles in Dye Dispersion (i) had a mean particle diameter of 0.4 $\mu$m.

Dye II

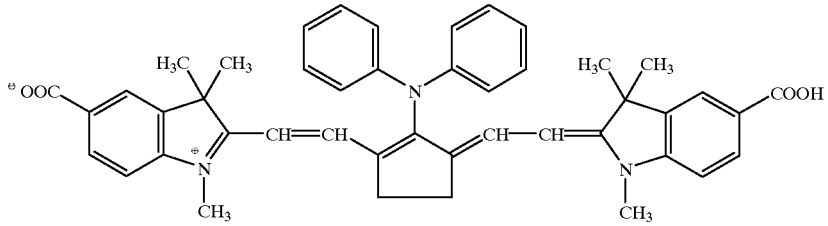

Dispersant V

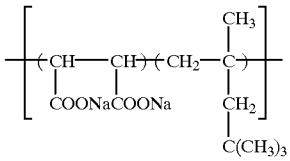

Mw = 14,300

Additive D

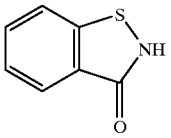

Preparation of Surface Protective Layer Coating Solution

A surface protective layer coating solution was prepared such that a surface protective layer might contain respective components in the following coverages on one side of a support

| | |
|---|---|
| Gelatin | 0.33 g/m$^2$ |
| Additive D | 1.4 mg/m$^2$ |
| Sodium polyacrylate (Mw 41,000) | 34 mg/m$^2$ |
| Additive 1 | 40 mg/m$^2$ |
| Additive 2 | 5.4 mg/m$^2$ |
| Additive 3 | 22.5 mg/m$^2$ |
| Additive 4 | 0.5 mg/m$^2$ |
| Matte agent 1 (mean particle size 3.7 $\mu$m) | 72.5 mg/m$^2$ |
| Compound IX | 4.4 mg/m$^2$ |
| Compound X | 1.3 mg/m$^2$ |

The addenda used herein have the following chemical formulas.

Additive D

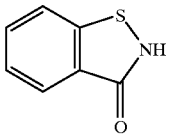

Additive 1

$C_{18}H_{33}O-(CH_2CH_2O)_{10}-H$

Additive 2

$C_8F_{17}SO_3K$

Additive 3

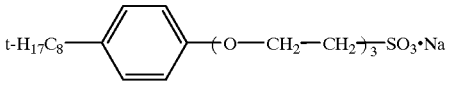

-continued

Additive 4

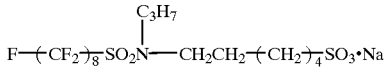

Matte agent 1

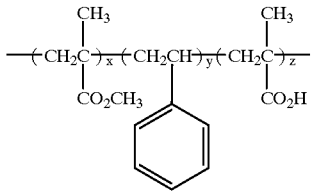

[X/Y/Z = 76. 3/17. 5/6. 2]

Compound IX

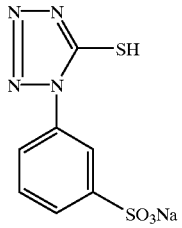

Compound X

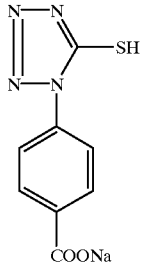

Preparation of Intermediate Layer Coating Solution

An intermediate layer coating solution was prepared such that an intermediate layer might contain respective components in the following coverages on one side of a support.

Gelatin 0.33 mg/m$^2$

Potassium polystyrenesulfonate 20 mg/m$^2$

Preparation of Support 1

A biaxially oriented polyethylene terephthalate (PET) film of 175 $\mu$m thick was subject to corona discharge treatment. A hydrophobic polymer layer was coated on each surface of the PET film by means of a wire bar coater so as to give the following coverage and dried at 185° C. for one minute. Note that the PET film used was non-colored and designated Support 1. It had a transmission white light density of 0.03.

Hydrophobic Polymer Layer

Butadiene-styrene copolymer latex (butadiene/styrene=31/69 by weight) 0.32 g/m$^2$ Sodium salt of 2,4-dichloro-6-hydroxy-s-triazine 8.4 mg/m$^2$ Note that the latex contained 0.4% by weight based on the latex solids of Emulsifying Dispersant A shown below.

Emulsifying Dispersant A

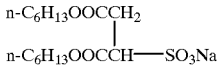

Next, a hydrophilic colloid layer was coated on each surface of the PET film by means of a wire bar coater so as to give the following coverage and dried at 155° C. for one minute.

| Hydrophilic colloid layer | |
|---|---|
| Gelatin | 80 mg/m$^2$ |
| Polyethyl acrylate | 20 mg/m$^2$ |
| Coating Aid B | 1.8 mg/m$^2$ |
| Dye III | 40 mg/m$^2$ |
| Additive D | 0.27 mg/m$^2$ |

The addenda used herein have the following chemical formulas.

Coating Aid B

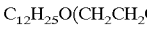

Dye III

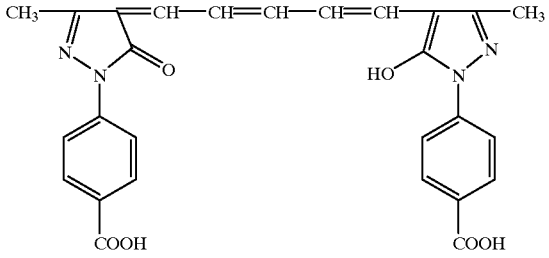

-continued

Additive D

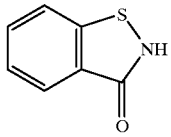

Dye III was added as a solid particle dispersion.

A mixture of 20 g of Dye III, 200 g of a 1% carboxymethyl cellulose aqueous solution, and 287 g of water was milled for 8 hours in an Eiger mill (Eiger Japan K.K.) at 5,000 rpm using zirconia ($ZrO_2$) beads with a diameter of 2 mm. The mixture was filtered to remove the zirconia beads. The mixture was dispersed in an aqueous gelatin solution, obtaining a solid particle dispersion of Dye III. It had a dye concentration of 12% by weight and the dye solid particles had a mean particle diameter of 0.37 $\mu$m.

Preparation of Photosensitive Element

Onto both sides of the above-prepared support, the dye layer, emulsion layer, intermediate layer, and surface protective layer prepared above were applied by the co-extrusion method. The silver coverage on one side was 1.3 g/m$^2$. Coated samples were prepared in this way while selecting one of pigment dispersions A to F and dye emulsion (a), and changing its addition position and amount as shown in Table 1.

Evaluation of Photoaraphic Properties

A photographic element sample was subjected to X-ray sensitometry by closely flanking the sample by x-ray orthoscreens HGM manufactured by Fuji Photo Film Co., Ltd. and exposing the sample to radiation for 0.05 sec. from both sides. The exposure dose was adjusted by changing the distance between the X-ray bulb and the cassette. After exposure, the sample was processed through an automatic processor using a developer and fixer of the following formulations.

Processor: automatic processor model CEPROS-30 by Fuji Photo Film Co., Ltd.

Processing:

| Developer concentrate | |
|---|---|
| Part A | |
| Potassium hydroxide | 330 g |
| Potassium sulfite | 630 g |
| Sodium sulfite | 255 g |
| Potassium carbonate | 90 g |
| Boric acid | 45 g |
| Diethylene glycol | 180 g |
| Diethylenetriaminepentaacetic acid | 30 g |
| 1-(N,N-diethylamino)ethyl-5-mercaptotetrazole | 0.75 g |
| Hydroquinone | 450 g |
| 4-hydroxymethyl-4-methyl-1-phenyl-3-pyrazolidone | 60 g |
| Water to make | 4125 ml |
| Part B | |
| Diethylene glycol | 525 g |
| 3'3'-dithiobishydrocinnamic acid | 3 g |
| Glacial acetic acid | 102.6 g |
| 2-nitroindazole | 3.75 g |
| 1-phenyl-3-pyrazolidone | 34.5 g |
| Water to make | 750 ml |
| Part C | |
| Glutaraldehyde (50 wt %) | 150 g |

-continued

| | |
|---|---|
| Potassium bromide | 15 g |
| Potassium metabisulfite | 105 g |
| Water to make | 750 ml |
| Fixer concentrate | |
| Ammonium thiosulfate (70 wt/vol %) | 3000 ml |
| Disodium ethylenediaminetetraacetate dihydrate | 0.45 g |
| Sodium sulfite | 225 g |
| Boric acid | 60 g |
| 1-(N,N-diethylamine)ethyl-5-mercaptotetrazole | 15 g |
| Tartaric acid | 48 g |
| Glacial acetic acid | 675 g |
| Sodium hydroxide | 225 g |
| Sulfuric acid (36N) | 58.5 g |
| Aluminum sulfate | 150 g |
| Water to make | 6000 ml |
| pH | 4.68 |

Preparation of Processing Solutions

There was furnished a container having three compartments, which were filled with Parts A, B, and C of the developer concentrate, respectively.

Another container was filled with the fixer concentrate.

First, the developing tank was charged with 300 ml of an aqueous solution containing 54 g of acetic acid and 55.5 g of potassium bromide as a starter.

The containers were turned down and placed in stock tanks on one side of the processor whereby the seals of the containers were broken by cutters in the stock tanks and the stocks tanks were filled with the respective processing solutions.

The processing solutions were mixed with water and pumped to the developing and fixing tanks of the processor at the rates shown below. Whenever 8 photosensitive sheets of 10×12 inches were processed, the processing concentrate solutions were mixed with water and replenished to the processing tanks at the same rates.

| | |
|---|---|
| Developer | |
| Part A | 51 ml |
| Part B | 10 ml |
| Part C | 10 ml |
| Water | 125 ml |
| pH | 10.50 |
| Fixer | |
| Concentrate | 80 ml |
| Water | 120 ml |
| pH | 4.62 |

The washing tank was filled with city water. There were furnished three polyethylene vials each containing 0.4 g of pearlite with a mean particle size of 100 μm and a mean pore diameter of 3 μm carrying actinomyces thereon as a bio-slime controlling agent. The opening of the vial was covered with nylon fabric of 300 mesh so that water and actinomyces might pass through the fabric. Two vials were placed on the bottom of the washing tank and one vial was placed on the bottom of the washing water stock tank having a volume of 0.2 liter.

| Processing temperature and time | | |
|---|---|---|
| Development | 35° C. | 8.8 sec. |
| Fixation | 32° C. | 7.7 sec. |
| Water washing | 17° C. | 3.8 sec. |
| Squeezing | | 4.4 sec |
| Drying | 58° C. | 5.3 sec. |
| Total | | 30 sec. |
| Replenishment | Developer | 8 ml/10 × 12 inches |
| | Fixer | 8 ml/10 × 12 inches |

Pigment's Contribution to the White Light Transmission Density of Unexposed Area An unexposed sample was subjected to only fixation and water washing and thereafter, further subjected to development, fixation and water washing, followed by drying. The processed sample was measured for white light transmission density, using the visual filter of a Macbeth densitometer TD-904. The support was similarly measured for white light transmission density. The difference in white light transmission density between the sample and the support was the white light transmission density of the pigment. The pigment's density divided by the white light transmission density of the processed (unexposed) sample was computed to give the pigment's contribution. The results are shown in Table 1.

Sensitivity

Sensitivity was determined as a logarithmic value of a reciprocal of the exposure dose necessary to provide a density of the fog+0.3. The sensitivity was expressed by a relative value based on 1.0 for sample No. 7. The results are shown in Table 2.

Tone of Developed Silver

In a sensory test, the processed sample was observed for the tone of developed silver under reflected light. The sample was rated on a 5-point scale, with the tone becoming better in the order from point 1 to point 5. The results are shown in Table 2.

Staining of Intensifying Screen

Screen cleaner test

A suitable amount of a screen cleaner (manufactured by Fuji Photo Film Co., Ltd.) was applied to a x-ray ortho-screen HGM (manufactured by Fuji Photo Film Co., Ltd.). The screen was closely rested on a sample prior to development, and a load of 10 kg was applied thereon at 40° C. for 3 days. Thereafter, the screen on its surface was wiped with cotton wadding impregnated with the screen cleaner, and the wadding was visually observed for stain. The staining of the intensifying screen by the sample was rated according to the following criterion.

⊙: no stain

○: substantially no stain

X: stained

The results are shown in Table 2.

Friction resistance test

Fifty sheets of the sample prior to development. In an atmosphere of temperature 25° C. and humidity 70%, each sheet was rubbed 20 strokes with a cotton fabric under a predetermined pressure. The fabric was visually observed for stain. Evaluation was made according to the following criterion.

⊙: no stain

○: substantially no stain

X: stained

XX: heavily stained

The results are shown in Table 2.

TABLE 1

| Sample No. | Emulsion | Support | Pigment dispersion Type | Amount ($mg/m^2$) | λ max (nm) | Added position | White light transmission density of support | White light transmission density of unexposed area of photosensitive element | Contribution of pigment to white light transmission density (%) |
|---|---|---|---|---|---|---|---|---|---|
| 1* | A | 1 | A | 61 | 615 | Surface protective layer | 0.03 | 0.20 | 85 |
| 2* | A | 1 | A | 61 | 615 | Intermediate layer | 0.03 | 0.20 | 85 |
| 3* | A | 1 | A | 61 | 615 | Emulsion layer | 0.03 | 0.20 | 85 |
| 4* | A | 1 | B | 36 | 625 | Surface protective layer | 0.03 | 0.20 | 85 |
| | | | C | 1.2 | | | | | |
| 5* | A | 1 | B | 36 | 625 | Intermediate layer | 0.03 | 0.20 | 85 |
| | | | C | 1.2 | | | | | |
| 6** | A | 1 | a (Dye) | 48 | 635 | Surface protective layer | 0.03 | 0.20 | 85 |
| 7** | A | 1 | — | — | — | — | 0.03 | 0.03 | — |
| 8** | A | 1 | D | 42 | 610 | Surface protective layer | 0.03 | 0.22 | 86 |
| 9** | A | 1 | E | 24 | 580 | Surface protective layer | 0.03 | 0.22 | 86 |
| | | | F | 5 | | | | | |

*invention
**comparison

TABLE 2

| Sample No. | Relative sensitivity | Tone of developed silver | Screen cleaner test | Friction resistance test | Remarks |
|---|---|---|---|---|---|
| 1 | 0.97 | 5 | ○ | ○ | invention |
| 2 | 0.97 | 5 | ◎ | ◎ | invention |
| 3 | 0.98 | 3 | ◎ | ◎ | invention |
| 4 | 0.97 | 5 | ○ | ○ | invention |
| 5 | 0.97 | 5 | ◎ | ◎ | invention |
| 6 | 0.97 | 5 | X | XX | comparsion |
| 7 | 1.0 | 1 | ◎ | ◎ | comparsion |
| 8 | 0.97 | 5 | ○ | X | comparsion |
| 9 | 0.97 | 5 | ○ | X | comparsion |

It is evident from Table 2 that the photosensitive elements within the scope of the invention are improved in the reflection tone of developed silver, friction resistance and screen cleaner inertness.

Additionally, a sample No. 10 was similarly prepared by adding dye emulsion (a) to the intermediate layer, and a sample No. 11 was similarly prepared by adding the pigment water dispersion D to the intermediate layer. For the combinations of sample No. 1 with No. 6, No. 1 with No. 8, No. 2 with No. 10, and No. 2 with No. 11, the friction resistance was compared. The samples of the invention wherein the pigment dispersion was added to the surface protective layer were improved in friction resistance to a greater extent than the samples of the invention wherein the pigment dispersion was added to the intermediate layer.

Example 2

The same samples as in Example 1 were examined as in Example 1 except that the processing conditions were changed as follows.

Concentrate Developer

A concentrate developer A using sodium erythorbate as a developing agent was prepared according to the following formulation.

| | |
|---|---|
| Diethylenetriamine pentaacetate | 8.0 g |
| Sodium sulfite | 20.0 g |

-continued

| | |
|---|---|
| Sodium carbonate monohydrate | 52.0 g |
| Potassium carbonate | 55.0 g |
| Sodium erythorbate | 60.0 g |
| 4-hydroxymethyl-4-methyl-1-phenyl-3-pyrazolidone | 13.2 g |
| 3,3'-diphenyl-3,3'-dithiopropionic acid | 1.44 g |
| Diethylene glycol | 50.0 g |
| Compound: | 0.15 g |

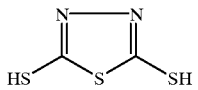

Compound: 0.3 g

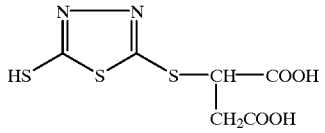

Water was added to a total volume of 1 liter. The developer was adjusted to pH 10.1 with sodium hydroxide.

Developer Replenisher

The concentrate developer was diluted with water by a factor of 2 before it was used as a developer replenisher.

Developer Mother Solution

The concentrate developer, 2 liters, was diluted with water to 4 liters. To this, 55 ml per liter of a starter solution having the following composition was added, obtaining a developer mother solution at pH 9.5.

| | |
|---|---|
| Potassium bromide | 11.1 g |
| Acetic acid | 10.8 g |
| Water to make | 55 ml |

Concentrate Fixer

A concentrate fixer of the following formulation was prepared.

| | |
|---|---|
| Water | 0.5 liter |
| Ethylenediaminetetraacetic acid dihydrate | 0.05 g |
| Sodium thiosulfate | 200 g |
| Sodium bisulfite | 98.0 g |
| Sodium hydroxide | 2.9 g |

After adjustment to pH 5.2 with NaOH, water was added to a total volume of 1 liter.

Fixer Replenisher

The concentrate fixer was diluted with water by a factor of 2 before it was used as a fixer replenisher.

Fixer Mother Solution

The concentrate fixer, 2 liters, was diluted with water to 4 liters. The solution was at pH 5.4.

Processing of Photosensitive Element

Using the developer mother solution and fixer mother solution, the photosensitive element samples were processed. The developer replenisher and fixer replenisher each were replenished at a rate of 65 ml per square meter of the photosensitive element. The washing water was city water.

| Processing temperature and time | | |
|---|---|---|
| Development | 35° C. | 8 sec. |
| Fixation | 35° C. | 8 sec. |
| Water washing | 25° C. | 7 sec. |
| Drying | 55° C. | 7 sec. |
| Total | | 30 sec. |

As a result, a similar tendency was observed according to the sample construction. It was found that as in Example 1, the photosensitive elements within the scope of the invention are improved in the reflection tone of developed silver and the staining of intensifying screens.

Example 3

Emulsion B: Preparation of High Aspect Ratio (111) Tabular Grains Having a High Silver Iodide Content Emulsion B was prepared as was Emulsion A except that in the growth step subsequent to physical ripening using ammonia, potassium iodide was added to the potassium bromide aqueous solution in an amount of 1.5% of the entire silver quantity. Emulsion B had a silver iodide content of 1.5 mol % and substantially the same configurational characteristics as Emulsion A.

Emulsion C: Preparation of Low Aspect Ratio (111) AgBr Tabular Grains

In a reactor, 6.0 g of potassium bromide and 7.0 g of low-molecular weight gelatin having an average molecular weight of 15,000 were added to 1 liter of water. With stirring at 55° C., 37 ml of an aqueous solution containing 4.00 g of silver nitrate and 38 ml of an aqueous solution containing 5.9 g of potassium bromide were added over 37 seconds by the double jet method. After 18.6 g of gelatin was added, the solution was heated to 70° C. and 89 ml of an aqueous solution containing 9.80 g of silver nitrate was added over 22 minutes. Then 15 ml of 25% ammonia water was added, the solution was physically ripened for 15 minutes at the temperature, and 14 ml of a 100% acetic acid solution was added. Subsequently, an aqueous solution containing 153 g of silver nitrate and an aqueous solution of potassium bromide were added over 55 minutes by the controlled double jet method while maintaining the solution at pAg 8.1. Then 15 ml of a 2N potassium thiocyanate solution was added to the solution. After physical ripening for 5 minutes at the temperature, the temperature was lowered to 35° C. There were obtained monodisperse pure silver bromide tabular grains having a1=15%, average aspect ratio a2=4.5, an average projected area diameter a3=1.30 μm, an average thickness a4=0.29 μm, and a coefficient of variation of diameter of 17.0%.

The soluble salts were then removed by sedimentation. After the emulsion was heated at 40° C. again, 30 g of gelatin, 2.35 g of phenoxyethanol, and 0.8 g of sodium polystyrenesulfonate as a thickener were added to the emulsion, which was adjusted to pH 5.90 and pAg 8.00 with solutions of sodium hydroxide and silver nitrate.

Chemical Sensitization

Emulsion A prepared in Example 1 was subject to chemical sensitization while keeping at 57° C. with stirring. First, Thiosulfonic Acid Compound I was added in an amount of $1\times10^{-4}$ mol per mol of the silver halide. Then AgI fine grains having a diameter of 0.03 μm were added in an amount of 0.15 mol % based on the total silver amount. After 3 minutes, $1\times10^{-6}$ mol/mol of Ag of thiourea dioxide was added to the emulsion, which was kept at the temperature for 22 minutes for reduction sensitization. Then, 4-hydroxy-6-methyl-1,3,3a,7-tetraazaindene in an amount of $3\times10^{-4}$ mol per mol of the silver halide and dispersions of Sensitizing Dyes 1, 2, and 3 were concurrently added. The amount of Sensitizing Dye 1 added was $1.0\times10^{-3}$ mol per mol of the silver halide, the amount of Sensitizing Dye 2 added was $1.2\times10^{-5}$ mol per mol of the silver halide, the amount of Sensitizing Dye 3 added was $2.4\times10^{-4}$ mol per mol of the silver halide. Finally, calcium chloride was added.

Subsequently, sodium thiosulfate in an amount of $6\times10^{-6}$ mol per mol of the silver halide and Selenium Compound 1 in an amount of $4\times10^{-6}$ mol per mol of the silver halide were added, whereupon chloroauric acid in an amount of $1\times10^{-5}$ mol per mol of the silver halide and potassium thiocyanate in an amount of $2\times10^{-3}$ mol per mol of the silver halide were added. Further, a nucleic acid (trade name RNA-F by Sanyo Kokusaku Pulp K.K.) was added in an amount of 67 mg per mol of the silver halide. After 40 minutes, water-soluble Mercapto Compound 1 was added in an amount of $1\times10^{-4}$ mol per mol of the silver halide. The emulsion was cooled to 35° C., terminating chemical sensitization of the emulsion.

Emulsions B and C were similarly subject to optimum chemical sensitization.

Thiosulfonic Acid Compound I $C_2H_5SO_2SNa$

Sensitizing Dye 1

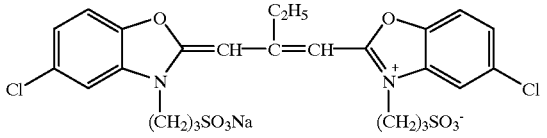

Sensitizing Dye 2

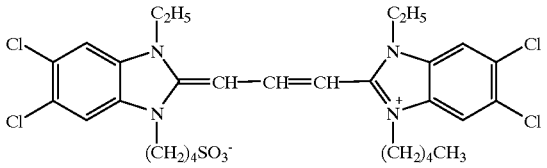

-continued

Sensitizing Dye 3

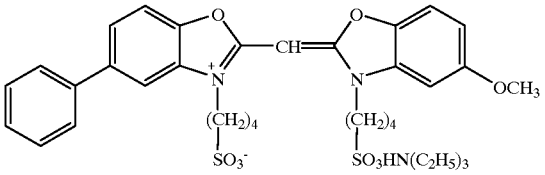

Selenium Compound 1

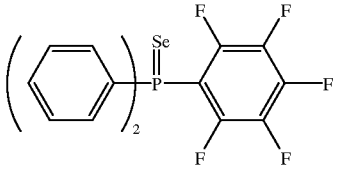

Mercapto Compound 1

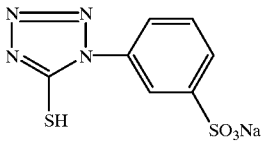

Preparation of Dispersions of Sensitizing Dyes 1, 2 and 3

Using a dissolver at 2,000 to 2,500 rpm, 1 g of each sensitizing dye was mechanically dispersed in 50 ml of water at pH 7.0±0.5 and a temperature of 50 to 65° C. as solid particles with a size of less than 1 μm. Then 50 g of 10% gelatin was added to the dispersion, which was mixed and cooled.

Preparation of Piament Dispersions A, B and C (invention)

Dispersions of Microlithblue A3R-K (C.I. Pigment Blue 60), Microlithblue 4G-K (C.I. Pigment Blue 15:3) and Microlithviolet B-K (C.I. Pigment Violet 37) by Ciba Geigy, designated Dispersions A, B, and C, respectively, were prepared as follows. By applying ultrasonic waves, 1.8 g of each pigment, 48.8 g of ethyl acetate, 1.8 g of High-Boiling Organic Solvent I, and 1.44 g of a 72% aqueous solution of sodium dodecylbenzenesulfonate were dispersed at 50° C. Then 7.2 g of gelatin, 0.72 g of a 3.5% aqueous solution of proxisel, and 104.4 ml of water were added. By operating a homogenizer at 12,000 rpm, the contents were emulsified and dispersed at 50° C. for 8 minutes. After the ethyl acetate was evaporated off by means of a rotary evaporator, water was added so as to give a total weight of 180 g and the temperature was lowered, obtaining a pigment dispersion.

High-Boiling Organic Solvent I

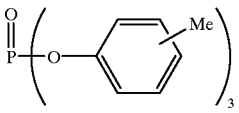

Preparation of Emulsion Coating Solution

An emulsion coating solution was prepared by adding the following chemicals to the chemically sensitized emulsion in amounts per mol of the silver halide.

| | |
|---|---|
| Gelatin (inclusive of gelatin in emulsion) | 80.6 g |
| Dextran (Mw 39,000) | 21.5 g |
| Sodium polyacrylate (Mw 400,000) | 5.1 g |
| Sodium polystyrenesulfonate (Mw 600,000) | 1.2 g |
| Potassium iodide | 78 mg |

Hardener: 1,2-bis (vinylsulfonylacetamide) ethane an amount to give a swelling factor of 140%

Further, the following Compounds I to VII were added in the following amounts.

| | |
|---|---|
| Compound I | 70 mg |
| Compound II | 5.0 g |
| Compound III | 0.58 g |
| Compound IV | 30 mg |
| Compound V | 6.0 mg |
| Compound VI | 0.1 g |
| Compound VII | 0.1 g |

Their structural formulas are shown below.

Compound I

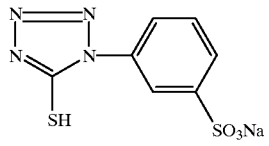

Compound II

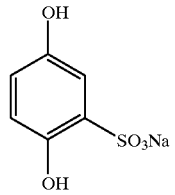

Compound III

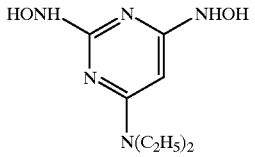

Compound IV

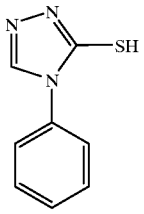

Compound V

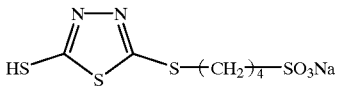

Compound VI

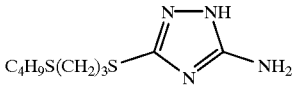

-continued

Compound VII

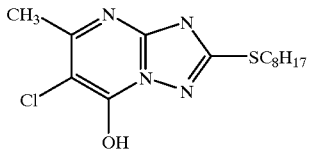

Further, the following polymer latex having an active methylene group was added in such an amount as to give a coverage of 0.8 g/m$^2$.

Polymer latex:

Core: styrene/butadiene (37/63 wt %) copolymer

Shell: styrene/2-acetoacetoxyethyl methacrylate (84/16 wt %) copolymer

Core/shell=50/50 wt % adjusted to pH 6.1 with NaOH

Preparation of Dye Layer Coating Solution

A dye layer coating solution was prepared such that a dye layer to be coated under the emulsion layer might contain respective components in the following coverages.

| | |
|---|---|
| Gelatin | 0.25 g/m$^2$ |
| Additive D | 1.4 mg/m$^2$ |
| Sodium polystyrenesulfonate (Mw 600,000) | 5.9 mg/m$^2$ |
| Dye dispersion (i) (as dye solids) | 20 mg/m$^2$ |

Preparation of Dye Dispersion (i)

Dye II shown below was used as a wet cake without drying and weighed so as to give 6.3 g of dry solids. Dispersant V shown below was used as a 25 wt % aqueous solution and added to the wet cake of dye in such an amount as to give a dry solid amount corresponding to 30% by weight of the dye solids. Water was added to a total weight of 63.3 g and the mixture was thoroughly agitated to form a slurry. The slurry was admitted into a vessel together with 100 ml of zirconia beads with a mean diameter of 0.5 mm. A dispersing machine 1/16G sand grinder mill (Imex K.K.) was operated for 6 hours for dispersion. Water was added to the dispersion so as to give a dye concentration of 8% by weight, yielding a dye dispersion.

This dispersion was mixed with photographic gelatin such that the dye solid content was 5% by weight and the content (in % by weight) of gelatin was equal to the dye solid content. An aqueous solution of Additive D shown below as an antiseptic agent was added to the dispersion in such an amount that Additive D was 2,000 parts by weight per million parts by weight of gelatin. The dispersion was refrigerated and stored in jelly form.

In this way, Dye Dispersion (i) was obtained as an undissolvable solid particle dispersion having a light absorption peak at 915 nm. Solid particles in Dye Dispersion (i) had a mean particle diameter of 0.4 μm.

Dye II

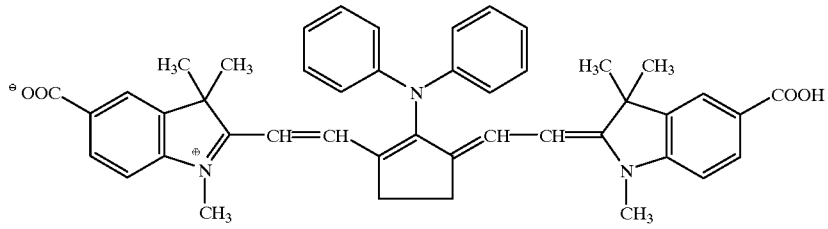

Dispersant V

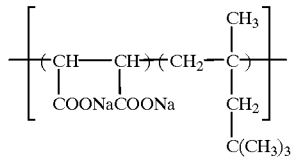

Mw = 14,300

Additive D

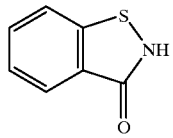

Preparation of Surface Protective Layer Coating Solution

A surface protective layer coating solution was prepared such that a surface protective layer might contain respective components in the following coverages on one side of a support.

| | |
|---|---|
| Gelatin | 0.33 g/m$^2$ |
| Additive D | 1.4 mg/m$^2$ |
| Sodium polyacrylate (Mw 41,000) | 34 mg/m$^2$ |
| Additive 1 | 40 mg/m$^2$ |
| Additive 2 | 5.4 mg/m$^2$ |
| Additive 3 | 22.5 mg/m$^2$ |
| Additive 4 | 0.5 mg/m$^2$ |
| Matte agent 1 (mean particle size 3.7 μm) | 72.5 mg/m$^2$ |

-continued

| | |
|---|---|
| Compound IX | 4.4 mg/m$^2$ |
| Compound X | 1.3 mg/m$^2$ |

The addenda used herein have the following chemical formulas.

Additive D

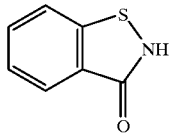

Additive 1

$C_{18}H_{33}O-(CH_2CH_2O)_{10}-H$

Additive 2

$C_8F_{17}SO_3K$

Additive 3

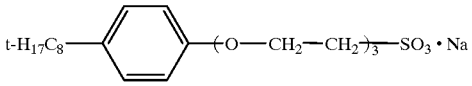

Additive 4

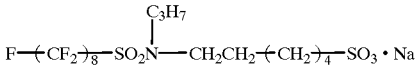

Matte agent 1

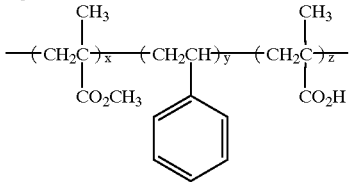

[X / Y / Z = 76.3 / 17.5 / 6.2]

Compound IX

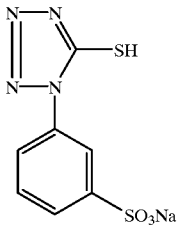

Compound X

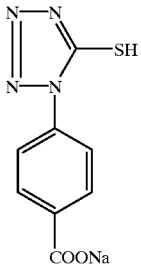

Preparation of Intermediate Layer Coating Solution

An intermediate layer coating solution was prepared such that an intermediate layer might contain respective components in the following coverages on one side of a support.

| | |
|---|---|
| Gelatin | 0.33 mg/m$^2$ |
| Potassium polystyrenesulfonate | 20 mg/m$^2$ |

Supports 1 and 2

A biaxially oriented polyethylene terephthalate (PET) film of 175 $\mu$m thick was subject to corona discharge treatment. A hydrophobic polymer layer was coated on each surface of the PET film by means of a wire bar coater so as to give the following coverage and dried at 185° C. for one minute. Note that the PET films used were a non-colored film and a film colored blue with Dye I, which are designated Supports 1 and 2, respectively. Supports 1 and 2 had a transmission white light density of 0.03 and 0.14, respectively.

Preparation of Photosensitive Element

Onto both sides of the above-prepared support, the dye layer, emulsion layer, intermediate layer, and surface protective layer prepared in Example 1 were applied by the co-extrusion method. The silver coverage on one side was 1.3 g/m$^2$. Coated samples were prepared in this way while selecting one of pigment dispersions A to C, and changing its addition position and amount as shown in Table 3.

Evaluation of Photographic Properties

A photographic element sample was subjected to X-ray sensitometry as in Example 1 by closely flanking the sample by x-ray ortho-screens HGM manufactured by Fuji Photo Film Co., Ltd. and exposing the sample to radiation for 0.05 sec. from both sides.

The samples were processed and tested as in Example 1. The results are shown in Tables 3 and 4. It is to be noted that the sensitivity, which was determined as a logarithmic value of a reciprocal of the exposure dose necessary to provide a density of the fog+0.3, was expressed by a relative value based on 1.0 for sample No. 24.

Residual Color Test

The photosensitive element was cut to sheets sized 30.5 cm×25.4 cm. The sheets were processed as above except that washing water was at 5° C. and the dry-to-dry processing time was 30 seconds. Residual color on the photosensitive element was visually observed and rated according to the following criterion.

◎: almost no residual color

○: faint residual color, but inoffensive

Δ: residual color, but practically acceptable

X: unacceptable residual color

TABLE 3

| Sample No. | Emulsion | Support | Pigment dispersion Type | Amount ($mg/m^2$) | λ max (nm) | Added position | White light transmission density of support | White light transmission density of unexposed area of photosensitive element | Contribution of pigment to white light transmission density (%) |
|---|---|---|---|---|---|---|---|---|---|
| 11* | A | 1 | A | 61 | 615 | Surface protective layer | 0.03 | 0.20 | 85 |
| 12* | A | 1 | A | 61 | 615 | Intermediate layer | 0.03 | 0.20 | 85 |
| 13* | A | 1 | A | 61 | 615 | Emulsion layer | 0.03 | 0.20 | 85 |
| 14* | A | 1 | B | 36 | 625 | Surface protective layer | 0.03 | 0.20 | 85 |
| | | | C | 1.2 | | | | | |
| 15* | A | 1 | B | 36 | 625 | Intermediate layer | 0.03 | 0.20 | 85 |
| | | | C | 1.2 | | | | | |
| 16** | B | 1 | A | 61 | 615 | Intermediate layer | 0.03 | 0.20 | 85 |
| 17** | C | 1 | A | 61 | 615 | Intermediate layer | 0.03 | 0.20 | 85 |
| 18** | A | 2 | A | 18 | 615 | Surface protective layer | 0.14 | 0.20 | 30 |
| 19** | A | 2 | A | 18 | 615 | Intermediate layer | 0.14 | 0.20 | 30 |
| 20** | A | 2 | A | 18 | 615 | Emulsion layer | 0.14 | 0.20 | 30 |
| 21* | A | 2 | A | 61 | 615 | Surface protective layer | 0.14 | 0.31 | 55 |
| 22* | A | 2 | A | 61 | 615 | Intermediate layer | 0.14 | 0.31 | 55 |
| 23* | A | 2 | A | 61 | 615 | Emulsion layer | 0.14 | 0.31 | 55 |
| 24** | A | 2 | — | — | — | — | 0.14 | 0.14 | — |

*invention
**comparison

TABLE 4

| Sample No. | Relative sensitivity | Tone of developed silver | Screen cleaner test | Residual color | Remarks |
|---|---|---|---|---|---|
| 11 | 0.97 | 5 | ○ | ○ | invention |
| 12 | 0.97 | 5 | ◎ | ○ | invention |
| 13 | 0.98 | 3 | ◎ | ○ | invention |
| 14 | 0.97 | 5 | ○ | ○ | invention |
| 15 | 0.97 | 5 | ◎ | ○ | invention |
| 16 | 1.2 | 5 | ◎ | X | comparison |
| 17 | 0.4 | 5 | ◎ | ○ | comparison |
| 18 | 0.98 | 2 | ○ | ○ | comparison |
| 19 | 0.98 | 2 | ◎ | ○ | comparison |
| 20 | 0.98 | 1 | ◎ | ○ | comparison |
| 21 | 0.96 | 5 | ○ | ○ | invention |
| 22 | 0.96 | 5 | ◎ | ○ | invention |
| 23 | 0.97 | 3 | ◎ | ○ | invention |
| 24 | 1.0 | 1 | ◎ | ○ | comparison |

It is evident from Table 4 that the photosensitive elements within the scope of the invention are improved in the reflection tone of developed silver. They are free of residual color. In the screen cleaner test, an improvement was made by properly selecting the type and addition position of the pigment.

In contrast, the samples in which no pigment was added and the samples in which the contribution of the pigment to the white light transmission density is outside the scope of the invention are inferior in the tone of developed silver. The samples in which the silver halide composition is outside the scope of the invention showed residual color, and the samples in which the tabularity is outside the scope of the invention underwent a considerable drop of sensitivity. Among the samples within the scope of the invention, sample Nos. 11 to 15 are superior in the image recognition after development to comparative sample Nos. 21 to 23.

Example 4

The same samples as in Example 3 were examined as in Example 3 except that the processing conditions were changed as in Example 2. As a result, a similar tendency was observed according to the sample construction. It was found that as in Example 3, the photosensitive elements within the scope of the invention are improved in the reflection tone of developed silver.

Example 5

Samples were prepared as in Example 3 except that during chemical sensitization, Tellurium Compound 1 was added in an amount of $4\times10^{-6}$ mol per mol of the silver halide, together with Selenium Compound 1. They were examined as in Example 3, finding equivalent results. It was found that the photosensitive elements within the scope of the invention are improved in the reflection tone of developed silver.

Tellurium Compound 1

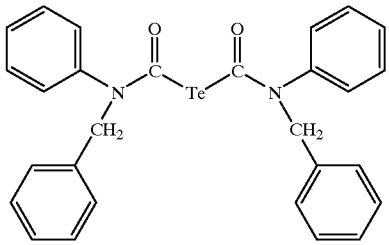

Example 6

Preparation of (100) AgCl Tabular Emulsion

A reactor was charged with 1,582 ml of an aqueous gelatin solution (containing 19.5 g of gelatin-1 (deionized, alkali-treated bone gelatin having a methionine content of about 40 μmol/g) and 7.8 ml of a 1N $HNO_3$ solution, pH 4.3) and 13 ml of a NaCl-1 solution (containing 10 g of NaCl in 100 ml of water). With the temperature kept at 40° C., 15.6 ml of an Ag-1 solution (containing 20 g of $AgNO_3$ in 100 ml of water) and 15.6 ml of a X-1 solution (containing 7.05 g of NaCl in 100 ml of water) were concurrently added to the reactor at a rate of 62.4 ml/min and mixed therein. After 3 minutes of agitation, 28.2 ml of an Ag-2 solution (containing 2 g of $AgNO_3$ in 100 ml of water) and 28.2 ml of a X-2 solution (containing 1.4 g of KBr in 100 ml of water) were concurrently added to the reactor at a rate of 80.6 ml/min and mixed therein. After 3 minutes of agitation, 46.8 ml of the Ag-1 solution and 46.8 ml of the X-1 solution were concurrently added to the reactor at a rate of 62.4 ml/min and mixed therein. After 2 minutes of agitation, 203 ml of an aqueous gelatin solution (containing 1.3 g of oxidized gelatin-1, 1.3 g of NaCl, and an amount of 1N NaOH solution to adjust to pH 5.5) was added to the solution to give pCl 1.8. Thereafter, the temperature was raised to 75° C., adjustment to pCl 1.8 was made, and the solution was ripened for 10 minutes. Thereafter, $1\times10^{-4}$ mol of Disulfide Compound A was added per mol of the silver halide, a AgCl fine grain emulsion (mean particle diameter 0.1 μm) was added over 20 minutes at a rate of $2.68\times10^{-2}$ mol/min of AgCl. After the completion of addition, the solution was ripened for 10 minutes. A flocculent was added to the solution, which was cooled to a temperature of 35° C. to cause grains to sediment. After water washing, an aqueous gelatin solution was added to the grains and the emulsion was adjusted to pH 6.0 at 60° C.

A TEM image of a replica of the grains was observed. The resultant emulsion was found to be an emulsion of high silver chloride {100} tabular grains containing 0.44 mol % based on silver of AgBr. The configurational characteristics of the grains were:

(the total projected area of tabular grains having an aspect ratio of at least 2)/(the sum of projected areas of entire AgX grains)×100=a1=98%, an average aspect ratio (average diameter/average thickness) of tabular grains=a2=9.3, an average diameter of tabular grains=a3=1.67 μm, and an average thickness of tabular grains=a4=0.18 μm.

Chemical Sensitization

The emulsion prepared above was subject to chemical sensitization while keeping at 60° C. with stirring. First, Thiosulfonic Acid Compound I was added in an amount of $1\times10^{-4}$ mol per mol of the silver halide. Then AgBr fine grains having a mean grain diameter of 0.10 μm were added in an amount of 1.0 mol % based on the total silver amount. After 5 minutes, a 1 wt % KI solution was added in an amount of $1\times10^{-3}$ mol per mol of the silver halide. After 3 minutes, $1\times10^{-6}$ mol/mol of Ag of thiourea dioxide was further added to the emulsion, which was kept at the temperature for 22 minutes for reduction sensitization. Then, $3\times10^{-4}$ mol/mol of Ag of 4-hydroxy-6-methyl-1,3,3a,7-tetraazaindene and dispersions of Sensitizing Dye 1, 2, and 3 were thoroughly mixed and added to the emulsion. The amounts of these dispersions added were $1.0\times10^{-3}$ mol of Sensitizing Dye 1, $1.2\times10^{-5}$ mol of Sensitizing Dye 2, and $2.4\times10^{-4}$ mol of Sensitizing Dye 3, per mol of the silver halide. Further, $3\times10^{-6}$ mol/mol of Ag of chloroauric acid and $1.8\times10^{-3}$ mol/mol of Ag of potassium thiocyanate were added. After 5 minutes, $4.6\times10^{-6}$ mol/mol of Ag of sodium thiosulfate and $1.2\times10^{-6}$ mol/mol of Ag of Selenium Compound 1 were added to the emulsion. After 5 minutes, 67 mg/mol of Ag of nucleic acid was added. After 30 minutes, $1\times10^{-4}$ mol/mol of Ag of water-soluble Mercapto Compound 1 was added to the emulsion, which was cooled to 35° C. In this way, the preparation or chemical ripening of the emulsion was completed.

Thiosulfonic Acid Compound I $C_2H_5SO_2SNa$

Sensitizing Dye 1

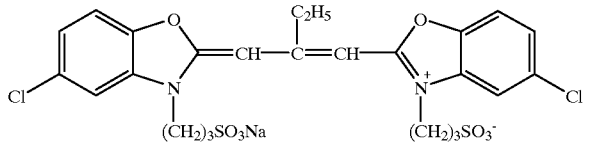

Sensitizing Dye 2

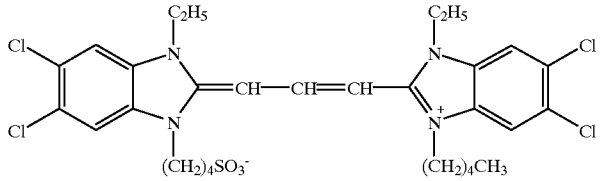

Sensitizing Dye 3

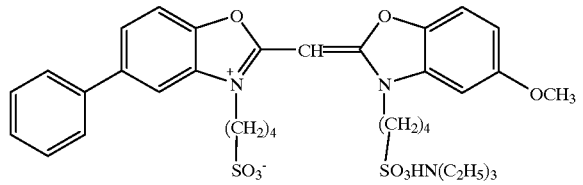

Selenium Compound 1

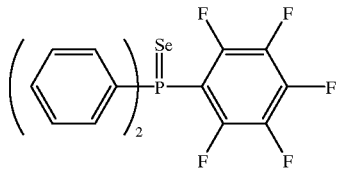

-continued

Mercapto Compound 1

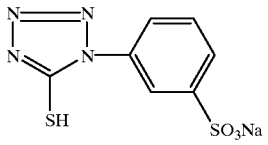

Preparation of Dispersions of Sensitizing Dyes 1, 2 and 3

Using a dissolver at 2,000 to 2,500 rpm, 1 g of each sensitizing dye was mechanically dispersed in 50 ml of water at pH 7.0±0.5 and a temperature of 50 to 65° C. as solid particles with a size of less than 1 μm. Then 50 g of 10% gelatin was added to the dispersion, which was mixed and cooled.

Preparation of Pigment Dispersions A, B and C

Dispersions of Microlithblue A3R-K (C.I. Pigment Blue 60), Microlithblue 4G-K (C.I. Pigment Blue 15:3) and Microlithviolet B-K (C.I. Pigment Violet 37) by Ciba Geigy, designated Dispersions A, B, and C, respectively, were prepared as follows. By applying ultrasonic waves, 1.8 g of each pigment, 48.8 g of ethyl acetate, 1.8 g of High-Boiling Organic Solvent I, and 1.44 g of a 72% aqueous solution of sodium dodecylbenzenesulfonate were dispersed at 50° C. Then 7.2 g of gelatin, 0.72 g of a 3.5% aqueous solution of proxisel, and 104.4 ml of water were added. By operating a homogenizer at 12,000 rpm, the contents were emulsified and dispersed at 50° C. for 8 minutes. After the ethyl acetate was evaporated off by means of a rotary evaporator, water was added so as to give a total weight of 180 g and the temperature was lowered, obtaining a pigment dispersion.

High-Boiling Organic Solvent I

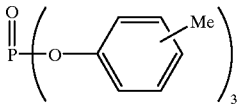

Preparation of Emulsion Coating Solution

An emulsion coating solution was prepared by adding the following chemicals to the chemically sensitized emulsion in amounts per mol of the silver halide.

| | |
|---|---|
| Gelatin (inclusive of gelatin in emulsion) | 80.6 g |
| Dextran (Mw 39,000) | 21.5 g |
| Sodium polyacrylate (Mw 400,000) | 5.1 g |
| Sodium polystyrenesulfonate (Mw 600,000) | 1.2 g |
| Potassium iodide | 78 mg |

Hardener: 1,2-bis (vinylsulfonylacetamide) ethane an amount to give a swelling factor of 140%

Further, the following Compounds I to VII were added in the following amounts.

| | |
|---|---|
| Compound I | 70 mg |
| Compound II | 5.0 g |
| Compound III | 0.58 g |
| Compound IV | 30 mg |
| Compound V | 6.0 mg |
| Compound VI | 0.1 g |
| Compound VII | 0.1 g |

Their structural formulas are shown below.

Compound I

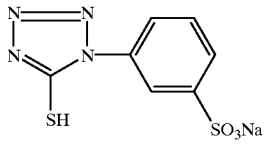

Compound II

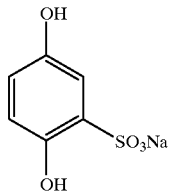

Compound III

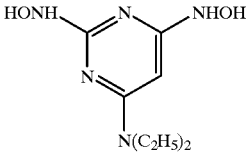

Compound IV

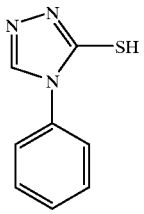

Compound V

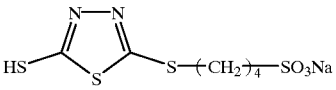

Compound VI

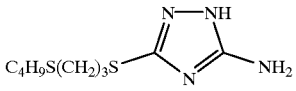

-continued

Compound VII

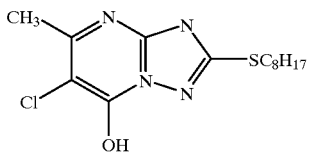

Further, the following polymer latex having an active methylene group was added in such an amount as to give a coverage of 0.8 g/m$^2$.

Polymer latex:

Core: styrene/butadiene (37/63 wt %) copolymer

Shell: styrene/2-acetoacetoxyethyl methacrylate (84/16 wt %) copolymer

Core/shell=50/50 wt % adjusted to pH 6.1 with NaOH

Preparation of Dye Layer Coating Solution

A dye layer coating solution was prepared such that a dye layer to be coated under the emulsion layer might contain respective components in the following coverages.

| | |
|---|---|
| Gelatin | 0.25 g/m$^2$ |
| Additive D | 1.4 mg/m$^2$ |
| Sodium polystyrenesulfonate (Mw 600,000) | 5.9 mg/m$^2$ |
| Dye dispersion (i) (as dye solids) | 20 mg/m$^2$ |

Preparation of Dye Dispersion (i)

Dye II shown below was used as a wet cake without drying and weighed so as to give 6.3 g of dry solids. Dispersant V shown below was used as a 25 wt % aqueous solution and added to the wet cake of dye in such an amount as to give a dry solid amount corresponding to 30% by weight of the dye solids. Water was added to a total weight of 63.3 g and the mixture was thoroughly agitated to form a slurry. The slurry was admitted into a vessel together with 100 ml of zirconia beads with a mean diameter of 0.5 mm. A dispersing machine 1/16G sand grinder mill (Imex K.K.) was operated for 6 hours for dispersion. Water was added to the dispersion so as to give a dye concentration of 8% by weight, yielding a dye dispersion.

This dispersion was mixed with photographic gelatin such that the dye solid content was 5% by weight and the content (in % by weight) of gelatin was equal to the dye solid content. An aqueous solution of Additive D shown below as an antiseptic agent was added to the dispersion in such an amount that Additive D was 2,000 parts by weight per million parts by weight of gelatin. The dispersion was refrigerated and stored in jelly form.

In this way, Dye Dispersion (i) was obtained as an undissolvable solid particle dispersion having a light absorption peak at 915 nm. Solid particles in Dye Dispersion (i) had a mean particle diameter of 0.4 $\mu$m.

Dye II

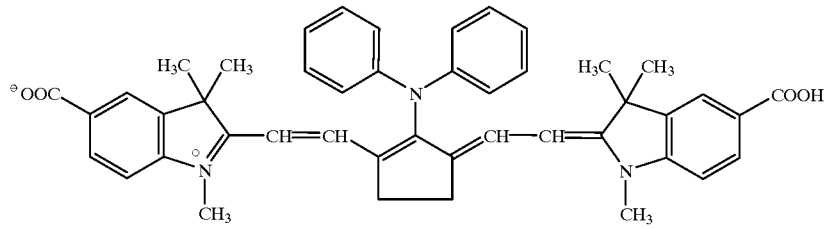

Dispersant V

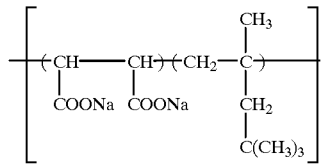

Mw = 14,300

Additive D

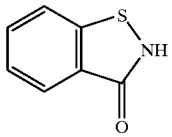

Preparation of Surface Protective Layer Coating Solution

A surface protective layer coating solution was prepared such that a surface protective layer might contain respective components in the following coverages on one side of a support.

| | |
|---|---|
| Gelatin | 0.33 g/m$^2$ |
| Additive D | 1.4 mg/m$^2$ |
| Sodium polyacrylate (Mw 41,000) | 34 mg/m$^2$ |
| Additive 1 | 40 mg/m$^2$ |
| Additive 2 | 5.4 mg/m$^2$ |
| Additive 3 | 22.5 mg/m$^2$ |

-continued

| | |
|---|---|
| Additive 4 | 0.5 mg/m$^2$ |
| Matte agent 1 (mean particle size 3.7 $\mu$m) | 72.5 mg/m$^2$ |
| Compound IX | 4.4 mg/m$^2$ |
| Compound X | 1.3 mg/m$^2$ |

The addenda used herein have the following chemical formulas.

Additive D

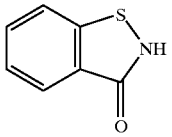

Additive 1

$C_{18}H_{33}O-(CH_2CH_2O)_{10}-H$

Additive 2

$C_8F_{17}SO_3K$

Additive 3

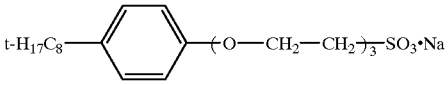

Additive 4

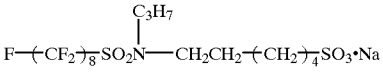

Matte agent 1

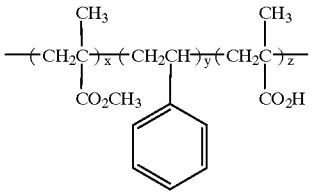

[X/Y/Z = 76. 3/17. 5/6. 2]

Compound IX

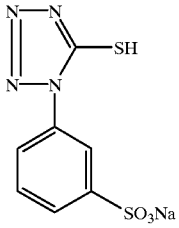

-continued

Compound X

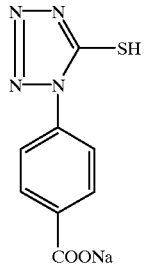

Preparation of Intermediate Layer Coating Solution

An intermediate layer coating solution was prepared such that an intermediate layer might contain respective components in the following coverages on one side of a support.

| | |
|---|---|
| Gelatin | 0.33 mg/m$^2$ |
| Potassium polystyrenesulfonate | 20 mg/m$^2$ |

Supports 1 and 2

A biaxially oriented polyethylene terephthalate (PET) film of 175 $\mu$m thick was subject to corona discharge treatment. A hydrophobic polymer layer was coated on each surface of the PET film by means of a wire bar coater so as to give the following coverage and dried at 185° C. for one minute. Note that the PET films used were a non-colored film and a film colored blue with Dye I, which are designated Supports 1 and 2, respectively. Supports 1 and 2 had a transmission white light density of 0.03 and 0.14, respectively.

Hydrophobic polymer layer

Butadiene-styrene copolymer latex (butadiene/styrene= 31/69 by weight) 0.32 g/m$^2$ Sodium salt of 2,4-dichloro-6-hydroxy-s-triazine 8.4 mg/m$^2$ Note that the latex contained 0.4% by weight based on the latex solids of Emulsifying Dispersant A shown below.

Emulsifying Dispersant A

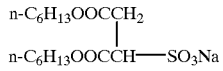

Next, a hydrophilic colloid layer was coated on each surface of the PET film by means of a wire bar coater so as to give the following coverage and dried at 155° C. for one minute.

| Hydrophilic colloid layer | |
|---|---|
| Gelatin | 80 mg/m$^2$ |
| Polyethyl acrylate | 20 mg/m$^2$ |
| Coating Aid B | 1.8 mg/m$^2$ |
| Dye III | 40 mg/m$^2$ |
| Additive D | 0.27 mg/m$^2$ |

The addenda used herein have the following chemical formulas.

-continued

| Hydrophilic colloid layer |
|---|
| Coating Aid B |
| $C_{12}H_{25}O(CH_2CH_2O)_{10}H$ |
| Dye III |

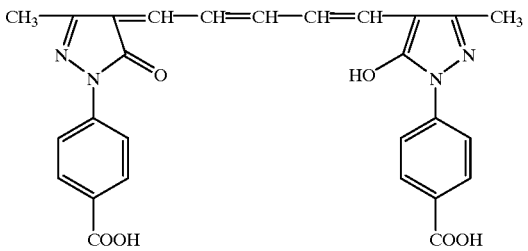

Additive D

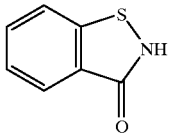

Dye III was added as a solid particle dispersion.

A mixture of 20 g of Dye III, 200 g of a 1% carboxymethyl cellulose aqueous solution, and 287 g of water was milled for 8 hours in an Eiger mill (Eiger Japan K.K.) at 5,000 rpm using zirconia ($ZrO_2$) beads with a diameter of 2 mm. The mixture was filtered to remove the zirconia beads. The mixture was dispersed in an aqueous gelatin solution, obtaining a solid particle dispersion of Dye III. It had a dye concentration of 12% by weight and the dye solid particles had a mean particle diameter of 0.37 $\mu$m.

Preparation of Photosensitive Element

Onto both sides of the above-prepared support, the dye layer, emulsion layer, intermediate layer, and surface protective layer prepared above were applied by the co-extrusion method. The silver coverage on one side was 1.3 g/m$^2$. Coated samples were prepared in this way while selecting one of pigment dispersions A to C, and changing its addition position and amount as shown in Table 5.

Evaluation of Photographic Properties

A photographic element sample was subjected to X-ray sensitometry by closely flanking the sample by x-ray orthoscreens HGM manufactured by Fuji Photo Film Co., Ltd. and exposing the sample to radiation for 0.05 sec. from both sides. The exposure dose was adjusted by changing the distance between the X-ray bulb and the cassette. After exposure, the sample was processed through an automatic processor using a developer and fixer of the following formulations.

Processor: automatic processor model CEPROS-30 by Fuji Photo Film Co., Ltd.

Processing:

Concentrate Developer

A concentrate developer A using sodium erythorbate as a developing agent was prepared according to the following formulation.

| | |
|---|---|
| Diethylenetriamine pentaacetate | 8.0 g |
| Sodium sulfite | 20.0 g |
| Sodium carbonate monohydrate | 52.0 g |
| Potassium carbonate | 55.0 g |
| Sodium erythorbate | 60.0 g |
| 4-hydroxymethyl-4-methyl-1-phenyl-3-pyrazolidone | 13.2 g |
| 3,3'-diphenyl-3,3'-dithiopropionic acid | 1.44 g |
| Diethylene glycol | 50.0 g |
| 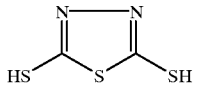 | 0.15 g |
| 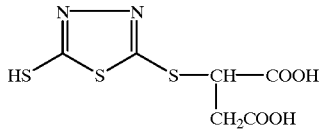 | 0.3 g |

Water was added to a total volume of 1 liter. The developer was adjusted to pH 10.1 with sodium hydroxide.

Developer Replenisher

The concentrate developer was diluted with water by a factor of 2 before it was used as a developer replenisher.

Developer Mother Solution

The concentrate developer, 2 liters, was diluted with water to 4 liters. To this, 55 ml per liter of a starter solution having the following composition was added, obtaining a developer mother solution at pH 9.5.

| Starter | |
|---|---|
| Potassium bromide | 11.1 g |
| Acetic acid | 10.8 g |
| Water to make | 55 ml |

Concentrate Fixer

A concentrate fixer of the following formulation was prepared.

| | |
|---|---|
| Water | 0.5 liter |
| Ethylenediaminetetraacetic acid dihydrate | 0.05 g |
| Sodium thiosulfate | 200 g |
| Sodium bisulfite | 98.0 g |
| Sodium hydroxide | 2.9 g |

After adjustment to pH 5.2 with NaOH, water was added to a total volume of 1 liter.

Fixer Replenisher

The concentrate fixer was diluted with water by a factor of 2 before it was used as a fixer replenisher.

Fixer Mother Solution

The concentrate fixer, 2 liters, was diluted with water to 4 liters. The solution was at pH 5.4.

Processing of Photosensitive Element

Using the developer mother solution and fixer mother solution, the photosensitive element samples were processed. The developer replenisher and fixer replenisher each were replenished at a rate of 65 ml per square meter of the photosensitive element. The washing water was city water.

| Step | Temperature | Time |
|---|---|---|
| Development | 35° C. | 8 sec. |
| Fixation | 35° C. | 8 sec. |
| Water washing | 25° C. | 7 sec. |
| Drying | 55° C. | 7 sec. |
| Total | | 30 sec. |

The samples were tested as in Example 1, with the results shown in Table 5. It is to be noted that the sensitivity, which was determined as a logarithmic value of a reciprocal of the exposure dose necessary to provide a density of the fog+0.3, was expressed by a relative value based on 1.0 for sample No. 42.

residual color, staining of fluorescent intensifying screens, and recognition of images.

Japanese Patent Application Nos. 354105/1997, 354106/1997, and 322355/1997 are incorporated herein by reference.

Reasonable modifications and variations are possible from the foregoing disclosure without departing from either the spirit or scope of the present invention as defined by the claims.

I claim:

1. A silver halide photographic element comprising a support and one or more hydrophilic layers on the support including at least one silver halide emulsion layer containing silver halide grains, wherein tabular grains having an aspect ratio of at least 5 account for at least 50% of the total projected area of the silver halide grains in said silver halide emulsion layer,

TABLE 5

| Sample No. | Pigment dispersion: Support | Type | Amount (mg/m$^2$) | λ max (nm) | Added layer | White light transmission density of support |
|---|---|---|---|---|---|---|
| 31 (invention) | 1 | A | 61 | 615 | Surface protective layer | 0.03 |
| 32 (invention) | 1 | A | 61 | 615 | Intermediate layer | 0.03 |
| 33 (invention) | 1 | A | 61 | 615 | Emulsion layer | 0.03 |
| 34 (invention) | 1 | B | 36 | 625 | Surface protective layer | 0.03 |
| | | C | 1.2 | | | |
| 35 (invention) | 1 | B | 36 | 625 | Intermediate layer | 0.03 |
| | | C | 1.2 | | | |
| 36 (comparison) | 2 | A | 18 | 635 | Surface protective layer | 0.14 |
| 37 (comparison) | 2 | A | 18 | 635 | Intermediate layer | 0.14 |
| 38 (comparison) | 2 | A | 18 | 635 | Emulsion layer | 0.14 |
| 39 (invention) | 2 | A | 61 | 635 | Surface protective layer | 0.14 |
| 40 (invention) | 2 | A | 61 | 635 | Intermediate layer | 0.14 |
| 41 (invention) | 2 | A | 61 | 635 | Emulsion layer | 0.14 |
| 42 (comparison) | 2 | — | — | — | — | 0.14 |
| 43 (comparison) | 1 | A | 18 | 635 | Surface protective layer | 0.03 |
| 44 (comparison) | 1 | A | 18 | 635 | Intermediate layer | 0.03 |
| 45 (comparison) | 1 | A | 18 | 635 | Emulsion layer | 0.03 |

| Sample No. | White light transmission density of unexposed area of photosensitive element | Contribution of pigment to white light transmission density (%) | Relative sensitivity | Reflection tone of developed silver | Screen cleaner test |
|---|---|---|---|---|---|
| 31 (invention) | 0.20 | 85 | 0.97 | 5 | ○ |
| 32 (invention) | 0.20 | 85 | 0.97 | 5 | ◎ |
| 33 (invention) | 0.20 | 85 | 0.98 | 3 | ◎ |
| 34 (invention) | 0.20 | 85 | 0.97 | 5 | ○ |
| 35 (invention) | 0.20 | 85 | 0.97 | 5 | ◎ |
| 36 (comparison) | 0.20 | 30 | 0.98 | 2 | ○ |
| 37 (comparison) | 0.20 | 30 | 0.98 | 2 | ◎ |
| 38 (comparison) | 0.20 | 30 | 0.98 | 1 | ◎ |
| 39 (invention) | 0.31 | 55 | 0.96 | 5 | ○ |
| 40 (invention) | 0.31 | 55 | 0.96 | 5 | ◎ |
| 41 (invention) | 0.31 | 55 | 0.97 | 3 | ◎ |
| 42 (comparison) | 0.14 | — | 1.0 | 1 | ◎ |
| 43 (comparison) | 0.09 | 67 | 0.98 | 2 | ○ |
| 44 (comparison) | 0.09 | 67 | 0.98 | 2 | ◎ |
| 45 (comparison) | 0.09 | 67 | 0.98 | 1 | ◎ |

It is evident from Table 5 that the photosensitive elements within the scope of the invention are equivalent in the staining of intensifying screens and improved in the reflection tone of developed silver.

There has been described a silver halide photographic element comprising a silver halide emulsion layer containing tabular silver halide grains and a hydrophilic colloid layer, either of which contains a specific pigment dispersed in lipophilic droplets of a high-boiling organic solvent. The photosensitive element of the invention has a high sensitivity and high silver covering power, and is improved in the transmission and reflection blackness of image silver, said silver halide emulsion layer or a hydrophilic colloid layer disposed above said silver halide emulsion layer contains a pigment having a maximum absorption wavelength between 570 nm and 650 nm, and said pigment is dispersed in lipophilic droplets formed of a water-immiscible high-boiling organic solvent having a boiling point of at least 140° C.

2. The element of claim 1 wherein said pigment is contained in the hydrophilic colloid layer disposed above said silver halide emulsion layer.

3. The element of claim 1 wherein said pigment is contained in a surface protective layer.

4. The element of claim 1 wherein said pigment is contained in the hydrophilic colloid layer disposed above said silver halide emulsion layer and below a surface protective layer.

5. The element of claim 1 wherein said pigment is contained in such an amount that the pigment may contribute to at least 50% of the white light transmission density of unexposed areas after development.

6. The element of claim 5 wherein said pigment is contained in such an amount that the pigment may contribute to at least 80% of the white light transmission density of unexposed areas after development.

7. The element of claim 1 wherein said pigment is (1) an anthraquinone pigment or (2) a metal phthalocyanine pigment and a dioxazine pigment.

8. The element of claim 1 wherein said tabular grains have been chemically sensitized with a selenium compound, tellurium compound or a mixture thereof.

9. The element of claim 1 wherein said support has not been dyed and where a subbing layer is present on said support, the subbing layer has not been dyed.

10. The element of claim 1 wherein the white light transmission density of unexposed areas after development is 0.15 to 0.35.

* * * * *